US011221135B2

(12) United States Patent
Goodwin et al.

(10) Patent No.: US 11,221,135 B2
(45) Date of Patent: Jan. 11, 2022

(54) DESUPERHEATER AND SPRAY NOZZLES THEREFOR

(71) Applicant: FISHER CONTROLS INTERNATIONAL LLC, Marshalltown, IA (US)

(72) Inventors: Justin P. Goodwin, Marshalltown, IA (US); Paul T. Alman, Marshalltown, IA (US)

(73) Assignee: FISHER CONTROLS INTERNATIONAL LLC, Marshalltown, IA (US)

( * ) Notice: Subject to any disclaimer, the term of this patent is extended or adjusted under 35 U.S.C. 154(b) by 0 days.

(21) Appl. No.: 16/386,663

(22) Filed: Apr. 17, 2019

(65) Prior Publication Data

US 2019/0376685 A1 Dec. 12, 2019

Related U.S. Application Data

(63) Continuation-in-part of application No. 16/133,298, filed on Sep. 17, 2018.

(Continued)

(51) Int. Cl.
*F22G 5/12* (2006.01)

(52) U.S. Cl.
CPC ..... *F22G 5/123* (2013.01)

(58) Field of Classification Search
CPC ... F22G 5/123; F22G 5/12; F22G 5/14; B05B 1/044; B05B 7/0458; B05B 13/0278;

(Continued)

(56) References Cited

U.S. PATENT DOCUMENTS 1,879,363 A * 9/1932 Loepsinger ..... B05B 15/5225 239/118
3,034,771 A * 5/1962 Harris ..... F22G 5/12 261/36.1

(Continued)

FOREIGN PATENT DOCUMENTS

DE 2810771 A1 9/1979
EP 1206973 A2 5/2002
JP 2002022108 A * 1/2002

OTHER PUBLICATIONS

International Search Report for PCT Application No. PCT/US2019/033872 dated Sep. 13, 2019.

(Continued)

*Primary Examiner* — Steven B McAllister
*Assistant Examiner* — Charles R Brawner
(74) *Attorney, Agent, or Firm* — Marshall, Gerstein & Borun LLP

(57) ABSTRACT

A spray nozzle assembly has a housing with a body and cap flange secure to the body to define a bore within the housing. A first aperture is formed through the body and intersects the bore and a second aperture is formed through the cap flange and intersects the bore. A nozzle sleeve is disposed within the bore and has a solid, unitary sleeve body. First and second fluid passages are formed through the sleeve body. The first fluid passage is in fluid communication with the first aperture and a first exit aperture in an end of the sleeve body. The second fluid passage is in fluid communication with the second aperture and second and third exit apertures in the end of the sleeve body, which are positioned on opposite sides of the first exit aperture. A portion of the second fluid passage surrounds the first fluid passage.

15 Claims, 16 Drawing Sheets

Related U.S. Application Data

(60) Provisional application No. 62/681,981, filed on Jun. 7, 2018.

(58) Field of Classification Search
CPC ... B05B 7/0466; B05B 7/0475; B05B 7/0807; F28C 3/08; B01F 5/18; B01F 3/022; B01F 3/04021; Y10S 261/13; F16L 9/19
USPC ..... 122/487; 137/599.03; 138/42, 113, 114
See application file for complete search history.

(56) References Cited

U.S. PATENT DOCUMENTS 5,262,091 A * 11/1993 Narabayashi ..... F04F 5/50 261/21
5,607,626 A * 3/1997 Kunkle ..... F22G 5/123 261/27
9,612,009 B2 4/2017 Goodwin et al.
2003/0217762 A1* 11/2003 Kobayashi ..... H01L 21/67051 134/2
2005/0284957 A1 12/2005 Haruch
2006/0125126 A1* 6/2006 Sherikar ..... F22G 5/123 261/62
2010/0219268 A1 9/2010 Wurz
2011/0057056 A1 3/2011 Ziminsky et al.
2011/0197594 A1 8/2011 Khosla et al.
2015/0128882 A1* 5/2015 Goodwin ..... F22G 5/123 122/487
2015/0352569 A1* 12/2015 Choi ..... F23D 11/345 239/102.1
2016/0290629 A1* 10/2016 Strebe ..... F22G 5/123
2017/0348721 A1* 12/2017 Kalsi ..... B05B 1/14

OTHER PUBLICATIONS

Written Opinion for PCT Application No. PCT/US2019/033872 dated Sep. 13, 2019.
Emerson Process Management, Control Valve Sourcebook Pulp & Paper, 218 pages.
Fisher TBX-T Desuperheater Product Bulletin, Sep. 2017, 4 pages.
Fisher Steam Conditioning Technologies Brochure, May 2014, 28 pages.
Power Solutions Brochure, Feb. 2016, 24 pages.

* cited by examiner

DESUPERHEATER AND SPRAY NOZZLES THEREFOR

CROSS-REFERENCE TO RELATED APPLICATIONS

This application is a continuation-in-part of U.S. patent application Ser. No. 16/133,298, entitled "Desuperheater and Spray Nozzles Therefor" and filed Sep. 17, 2018, which claims priority to U.S. Provisional Patent Application No. 62/681,981, entitled "Desuperheater and Spray Nozzles Therefor" and filed Jun. 7, 2018, the entire disclosures of which are hereby incorporated by reference herein.

FIELD OF THE INVENTION

The present invention relates to desuperheaters, which are commonly used on fluid and gas lines (e.g., steam lines) in the power and process industries, and further relates to spray nozzles for use with desuperheaters.

BACKGROUND

Desuperheaters are used in many industrial fluid and gas lines to reduce the temperature of superheated process fluid and gas to a desired set point temperature. For example, desuperheaters are used in power process industries to cool superheated steam. The desuperheater injects a fine spray of atomized cooling water or other fluid, referred to herein as a spraywater cloud, into the steam pipe through which the process steam is flowing. Evaporation of the water droplets in the spraywater cloud reduces the temperature of the process steam. The resulting temperature drop can be controlled by adjusting one or more control variables, such as the volume rate of injecting the cooling water and/or the temperature of the cooling water. The size of the individual droplets in the spraywater cloud and/or the pattern of the spraywater cloud can also be adjusted to control the time required for the temperature drop.

Steam assisted spray atomization is regarded as the most effective way of atomizing spray water in a desuperheating system. It produces the finest droplets, allowing for the quickest evaporation and cooling of the process fluid (typically steam).

Typically, a spraywater cloud requires some minimum length or run of straight pipe downstream from the injection point to ensure substantially complete evaporation of the individual atomized water droplets. Otherwise, the spraywater cloud may condense or not completely evaporate when a bend or split in the steam pipe is encountered. This length or run of straight pipe is typically referred to as a "downstream pipe length." A temperature sensor is also usually located at the end of the downstream pipe length to sense the resulting temperature drop of the steam.

A steam assisted desuperheater includes an atomizing head that combines a high velocity stream of steam, which is called atomizing steam, with a stream of cooling water to atomize the cooling water and produce the spraywater cloud. In steam assisted desuperheaters, the individual droplets in the spraywater cloud are typically smaller in size than in mechanically atomized desuperheaters and, therefore, evaporate more rapidly inside the steam pipe. Therefore, steam assisted desuperheaters may be used in applications where a shorter downstream pipe length is available.

However, typical nozzle sleeves for steam assisted desuperheaters require machining and welding of multiple components in order to create nozzle sleeves with separate steam and water passages. This can raise issues in certain applications where welds can fatigue and crack. In addition, the machining and welding steps required for typical nozzle sleeves are very time intensive and expensive.

In addition, in high temperature applications, such as those often found in power process industries, there are also thermal expansion concerns in the nozzle sleeves. In a typical nozzle sleeve, hot steam passes around an annulus and water passes through the center flow passage. Therefore, the outer wall of the nozzle sleeve is at the steam temperature and the inner wall of the nozzle sleeve, between the steam and water passages, is at or near the water temperature. Since the steam and water temperature may be several hundred degrees Fahrenheit different from each other, the differential thermal expansion is enough to cause excessive compressive and tensile stress on the nozzle sleeves. Therefore, the different expansion of the parts needs to be addressed.

SUMMARY

In accordance with one exemplary aspect of the present invention, a spray nozzle assembly for a desuperheater includes a housing that has a body and a cap flange secured to the body to define a bore within the housing. A first aperture is formed through the body and intersects the bore and a second aperture is formed through the cap flange and intersects the bore. A nozzle sleeve is disposed within the bore and has a solid, unitary sleeve body. A first fluid passage is formed through the sleeve body in fluid communication with the first aperture and with a first exit aperture in an end of the sleeve body. A second fluid passage is formed through the sleeve body in fluid communication with the second aperture, with a second exit aperture formed in the end of the sleeve body, and with a third exit aperture formed in the end of the sleeve body. A portion of the second fluid passage surrounds the first fluid passage and the second and third exit apertures are positioned on opposite sides of the first exit aperture.

In further accordance with any one or more of the foregoing exemplary aspect of the present invention, the spray nozzle assembly may further include, in any combination, any one or more of the following preferred forms.

In one preferred form, the first fluid passage comprises a first section that extends radially across the sleeve body and a second section that intersects the first section and extends longitudinally along the sleeve body.

In another preferred form, the end of the sleeve body comprises a planar first surface that extends perpendicular to a longitudinal axis of the nozzle sleeve and a planar second surface that extends from the first surface and at an acute angle to the longitudinal axis of the nozzle sleeve, the second exit aperture is formed through the first surface, and the first and third exit apertures are formed through the second surface.

In another preferred form, the end of the sleeve body comprises a planar first surface that extends perpendicular to a longitudinal axis of the nozzle sleeve, a planar second surface that extends from the first surface and at an acute angle to the longitudinal axis of the nozzle sleeve, and a planar third surface that extends from the second surface and parallel to the longitudinal axis of the nozzle sleeve, the second exit aperture is formed through the first surface, the first exit aperture is formed through the second surface, and the third exit aperture is formed through the third surface.

In another preferred form, the first, second, and third exit apertures are linearly extending slots.

In another preferred form, the first exit aperture is elliptical and the second and third exit apertures are arcuately extending slots.

In another preferred form, a desuperheater includes the spray nozzle assembly and has a ring body defining an axial flow path, a plurality of the spray nozzle assemblies disposed around the ring body, a water manifold connected to each of the spray nozzle assemblies for providing cooling water to each of the spray nozzle assemblies, and a steam manifold connected to each of the spray nozzle assemblies for providing atomizing steam to each of the spray nozzle assemblies, separately from the cooling water.

In accordance with another exemplary aspect of the present invention, a spray nozzle assembly for a desuperheater comprises a housing that has a body and a cap flange secured to the body to define a bore within the housing. A first aperture formed through the body and intersects the bore and a second aperture is formed through the cap flange and intersects the bore. A nozzle sleeve is disposed within the bore and has a solid, unitary sleeve body. A first fluid passage is formed through the sleeve body in fluid communication with the first aperture and a second fluid passage is formed through the sleeve body in fluid communication with the second aperture, with a portion of the second fluid passage surrounding the first fluid passage. A generally cylindrical inner wall is formed between the first fluid passage and the portion of the second fluid passage, a generally cylindrical outer wall surrounds the portion of the second fluid passage, and a plurality of support arms extend between the inner wall and the outer wall along a length of the portion of the second fluid passage.

In further accordance with any one or more of the foregoing exemplary aspect of the present invention, the spray nozzle assembly may further include, in any combination, any one or more of the following preferred forms.

In one preferred form, the plurality of support arms extend radially from the inner wall to the outer wall.

In another preferred form, the plurality of support arms extend tangentially from the inner wall.

In another preferred form, the plurality of walls are arcuate.

In another preferred form, the first fluid passage comprises a first section that extends radially across the sleeve body and a second section that intersects the first section and extends longitudinally along the sleeve body.

In another preferred form, the first fluid passage is in fluid communication with a first exit aperture formed in an end of the sleeve body and the second fluid passage is in fluid communication with a second exit aperture formed in the end of the sleeve body and with a third exit aperture formed in the end of the sleeve body. The second and third exit apertures are positioned on opposite sides of the first exit aperture and the end of the sleeve body comprises a planar first surface that extends perpendicular to a longitudinal axis of the nozzle sleeve and a planar second surface that extends from the first surface and at an acute angle to the longitudinal axis of the nozzle sleeve. The second exit aperture is formed through the first surface and the first and third exit apertures are formed through the second surface.

In another preferred form, the first fluid passage is in fluid communication with a first exit aperture formed in an end of the sleeve body and the second fluid passage is in fluid communication with a second exit aperture formed in the end of the sleeve body and with a third exit aperture formed in the end of the sleeve body. The second and third exit apertures are positioned on opposite sides of the first exit aperture and the end of the sleeve body comprises a planar first surface that extends perpendicular to a longitudinal axis of the nozzle sleeve, a planar second surface that extends from the first surface and at an acute angle to the longitudinal axis of the nozzle sleeve, and a planar third surface that extends from the second surface and parallel to the longitudinal axis of the nozzle sleeve. The second exit aperture is formed through the first surface, the first exit aperture is formed through the second surface, and the third exit aperture is formed through the third surface.

In another preferred form, a desuperheater includes the spray nozzle assembly and includes a ring body defining an axial flow path, a plurality of the spray nozzle assemblies disposed around the ring body, a water manifold connected to each of the spray nozzle assemblies for providing cooling water to each of the spray nozzle assemblies, and a steam manifold connected to each of the spray nozzle assemblies for providing atomizing steam to each of the spray nozzle assemblies, separately from the cooling water.

In accordance with another exemplary aspect of the present invention, a spray nozzle assembly for a desuperheater comprises a housing having a body and a cap flange secured to the body to define a bore within the housing. A first aperture is formed through the body and intersects the bore and a second aperture is formed through the cap flange and intersects the bore. A nozzle sleeve is disposed within the bore and has a solid, unitary sleeve body. A first fluid passage is formed through the sleeve body and is in fluid communication with the first aperture and a second fluid passage is formed through the sleeve body and is in fluid communication with the second aperture, with a portion of the second fluid passage surrounding the first fluid passage. An inner wall is formed between the first fluid passage and the portion of the second fluid passage and is corrugated along a length of the portion of the second fluid passage.

In further accordance with any one or more of the foregoing exemplary aspect of the present invention, the spray nozzle assembly may further include, in any combination, any one or more of the following preferred forms.

In one preferred form, the first fluid passage comprises a first section that extends radially across the sleeve body and a second section that intersects the first section and extends longitudinally along the sleeve body.

In another preferred form, the first fluid passage is in fluid communication with a first exit aperture formed in an end of the sleeve body and the second fluid passage is in fluid communication with a second exit aperture formed in the end of the sleeve body and with a third exit aperture formed in the end of the sleeve body. The second and third exit apertures are positioned on opposite sides of the first exit aperture and the end of the sleeve body comprises a planar first surface that extends perpendicular to a longitudinal axis of the nozzle sleeve and a planar second surface that extends from the first surface and at an acute angle to the longitudinal axis of the nozzle sleeve. The second exit aperture is formed through the first surface and the first and third exit apertures are formed through the second surface.

In another preferred form, the first fluid passage is in fluid communication with a first exit aperture formed in an end of the sleeve body and the second fluid passage is in fluid communication with a second exit aperture formed in the end of the sleeve body and with a third exit aperture formed in the end of the sleeve body. The second and third exit apertures are positioned on opposite sides of the first exit aperture and the end of the sleeve body comprises a planar first surface that extends perpendicular to a longitudinal axis of the nozzle sleeve, a planar second surface that extends from the first surface and at an acute angle to the longitudinal axis of the nozzle sleeve, and a planar third surface that extends from the second surface and parallel to the longitudinal axis of the nozzle sleeve. The second exit aperture is formed through the first surface, the first exit aperture is formed through the second surface, and the third exit aperture is formed through the third surface.

In another preferred form, a desuperheater includes the spray nozzle assembly and includes a ring body defining an axial flow path, a plurality of the spray nozzle assemblies disposed around the ring body, a water manifold connected to each of the spray nozzle assemblies for providing cooling water to each of the spray nozzle assemblies, and a steam manifold connected to each of the spray nozzle assemblies for providing atomizing steam to each of the spray nozzle assemblies, separately from the cooling water.

DETAILED DESCRIPTION

The desuperheater disclosed herein includes spray nozzle assemblies with nozzle sleeves having a solid, unitary bodies. The solid, unitary bodies have both water and steam passages formed within, which allows for jacketed steam atomization.

The use of nozzle sleeves having solid, unitary bodies increases the robustness of the design, as there are no welds or other connections to fatigue or crack and the bodies better resist thermal fatigue. These nozzle sleeves are also less expensive to manufacture.

The nozzle sleeves disclosed herein also provide an effective way of creating steam flow on both sides of the water injection location to "jacket" the water between two jets of steam. The bodies of the nozzle sleeve allow internal splitting of atomizing steam into upper and lower channels to surround the water, which ensures that all of the water is effectively atomized and no water is "bounced away" and escapes the steam jets.

The nozzle sleeves can be used in place of multi-piece nozzle sleeves, can be retrofitted into current spay nozzle assemblies having multi-piece nozzle sleeves, or could be used as the spray nozzle assembly in other forms of desuperheaters.

Figure 1:
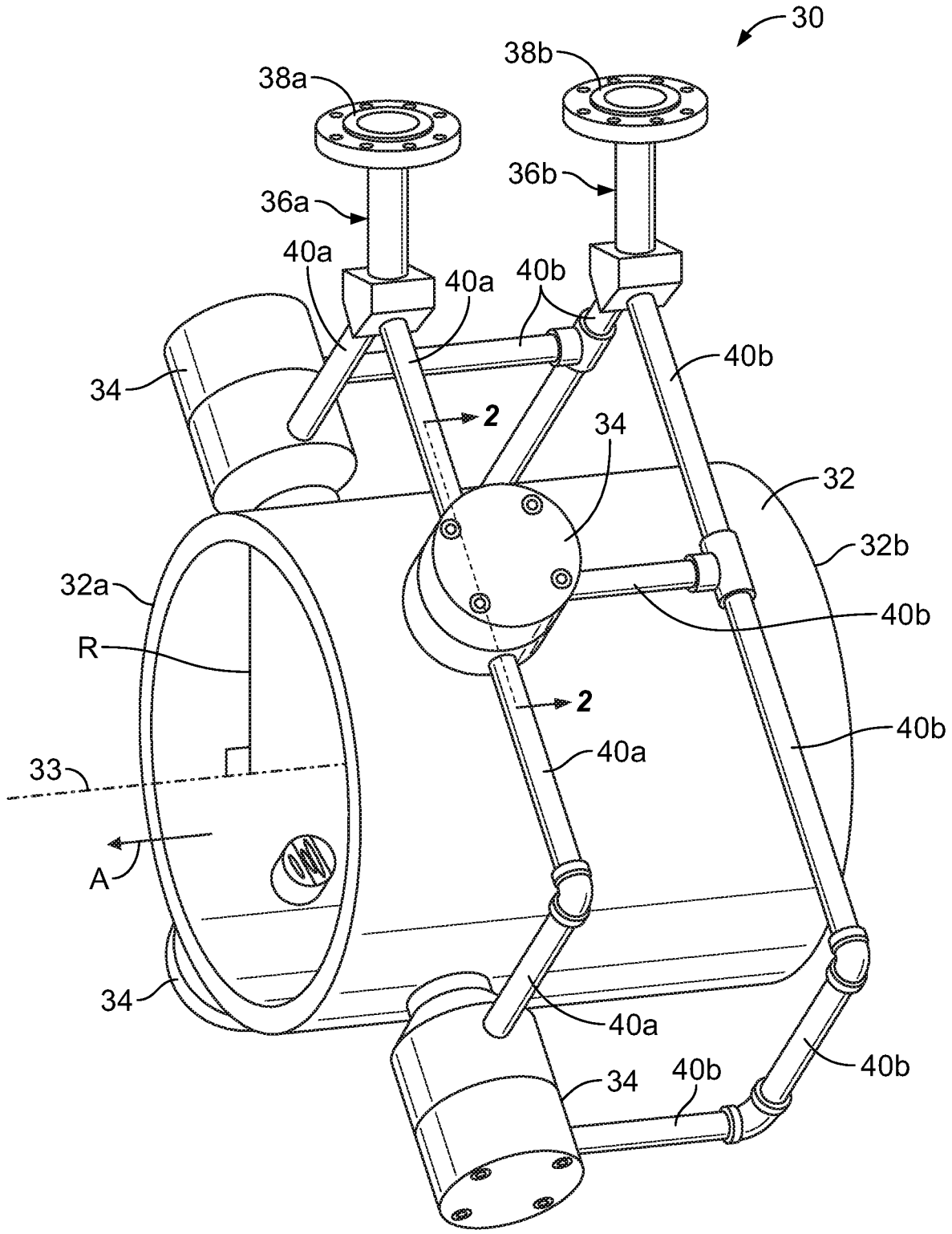
FIG. 1 is an isometric view of an example desuperheater according to the teachings of the present disclosure.

Turning now to the drawings, FIG. 1 illustrates an example desuperheater 30, which in the example shown is a ring style steam assisted desuperheater, according to one or more teachings of the present disclosure. Desuperheater 30 includes a ring body 32, at least one and preferably a plurality of spray nozzle assemblies 34 carried by the ring body, a water manifold 36*a* for providing cooling water to each of the spray nozzle assemblies, and a steam manifold 36*b* for providing atomizing steam to each of the spray nozzle assemblies 34. The water and steam manifolds 36*a*, 36*b* are disposed on a radially exterior side of the ring body 32 and are connected to a portion of each spray nozzle assembly 34 disposed on the exterior side of the ring body 32. Each spray nozzle assembly 34 is arranged to inject a spraywater cloud into the flow stream of process steam passing axially through ring body 32.

Ring body 32 defines an axial flow path "A", parallel to longitudinal axis 33 of ring body 32, for the passage of a process fluid, such as steam, therethrough and is preferably in the form of an elongate pipe section having a ring shaped cross-section with radius R extending axially from a first end 32*a* to a second end 32*b*. First and second ends 32*a*, 32*b* are arranged for connection and/or insertion between two opposing ends of pipe along a process steam pipeline and may be connected to opposing ends of pipe by, for example, welding, couplings, or fasteners. Ring body 32 optionally may include connection flanges (not shown) at each of the first and second ends 32*a*, 32*b* for bolted connection to opposing pipe sections in a manner well understood in the art.

Water manifold 36*a* includes connector 38*a* for connecting to a source of cooling water and one or more conduits 40*a* that operatively connect the connector 38*a* with each of the spray nozzle assemblies 34 to provide cooling water to the spray nozzle assemblies 34. Conduits 40*a* may be connected with one or more of the spray nozzle assemblies 34 in series, as shown in the present example, and/or in parallel. Steam manifold 36*b* includes connector 38*b* for connecting to a source of atomizing steam and one or more conduits 40*b* that operatively connect connector 38*b* with each of the spray nozzle assemblies 34. Conduits 40*b* may be connected with one or more of the spray nozzle assemblies 34 in parallel, as shown in the present example, and/or in series. Connectors 38*a*, 38*b* may be connector flanges or other well-known piping connections, such as butt-welds, socket weld ends, etc. Conduits 40*a*, 40*b* may be pipes, hoses, or other similar fluid conduits. In this arrangement, water manifold 36*a* provides cooling water to each of the spray nozzle assemblies 34 and steam manifold 36*b* supplies atomizing steam to each of the spray nozzle assemblies 34. The cooling water and the atomizing steam are provided separately and independently of each other to each of the spray nozzle assembly 34.

Figure 2:
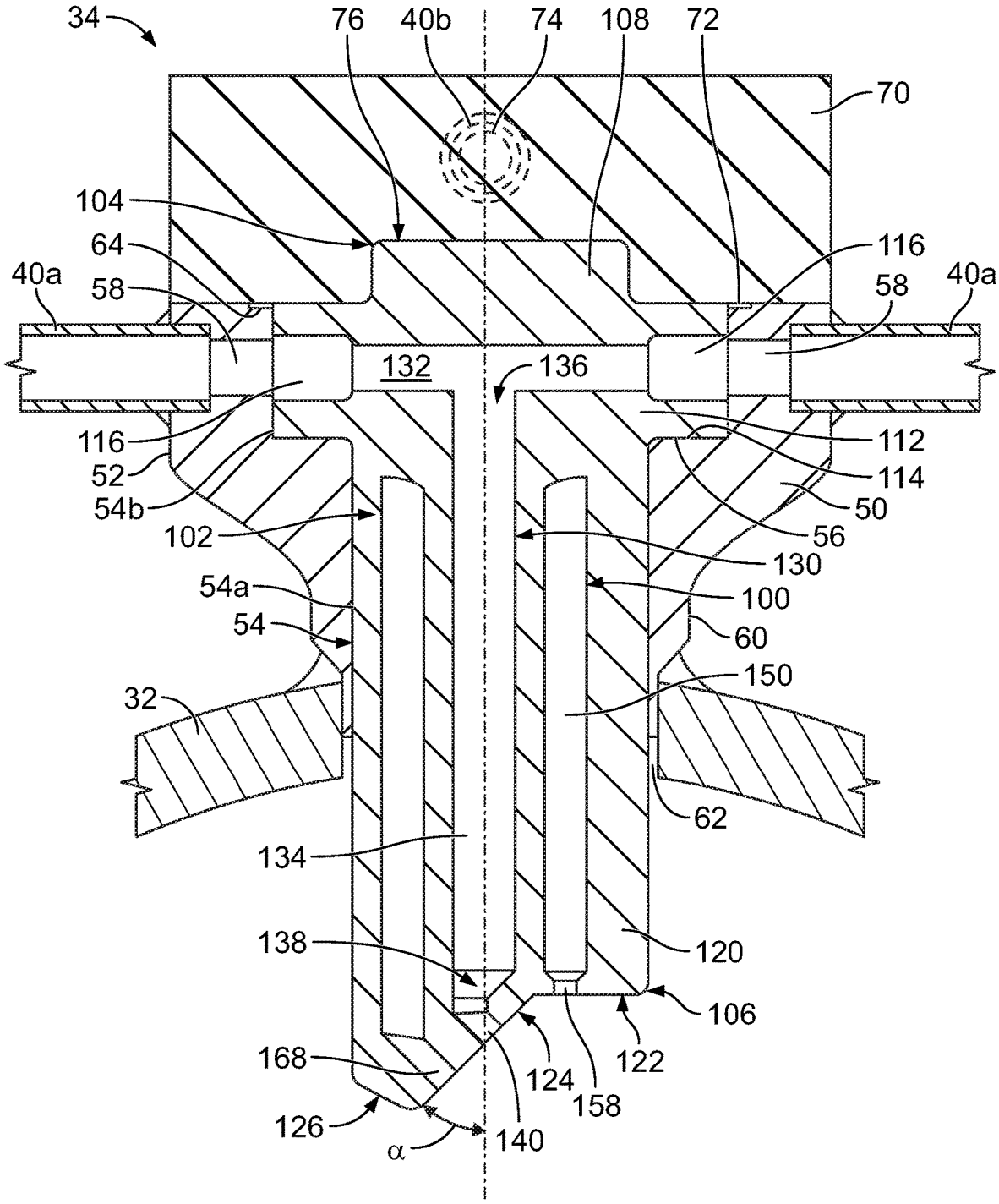
FIG. 2 is a cross-section view taken along the line 2-2 of FIG. 1 with an example spray nozzle assembly usable with the desuperheater of FIG. 1.

FIG. 2 illustrates an example spray nozzle assembly 34 operatively positioned in ring body 32. Each spray nozzle assembly 34 is preferably identical and/or identically arranged through ring body 32. Spray nozzle assembly 34 is adapted to receive and to conduct the cooling water and atomizing steam separately and independently through spray nozzle assembly 34 to inject a spraywater cloud into ring body 32. The spraywater cloud is a mixture of the atomizing steam and the cooling water. Spray nozzle assembly 34 includes housing 50 for connection to ring body 32, nozzle sleeve 100 received within housing 50, and cap flange 70.

Housing 50 includes body 52 and a neck 60 extending from body 52. Neck 60 is narrower than body 52 and, preferably, each of body 52 and neck 60 has a circular cross-section, although other shapes are possible. Body 52 is disposed on the exterior side of ring body 32 and neck 60 fits into an aperture 62 through the wall of ring body 32 and is secured to the wall of ring body 32, such as with one or more welds. Preferably, the weld also seals aperture 62. Stepped bore 54 extends axially from a first open end at a distal end of neck 60, through body 52, to a second open end opposite the first open end. Annular step 56 divides stepped bore 54 into first bore portion 54*a* and second bore portion 54*b*. First bore portion 54*a* extends from the first end of stepped bore 54 at the distal end of neck 60 to annular step 56 and second bore portion 54*b* extends from annular step 56 to the second end of stepped bore 54 at the upper surface of body 52. First bore portion 54*a* is narrower than second bore portion 54*b* and, preferably, each of the first and second bore portions 54*a*, 54*b* is in the form a straight cylindrical bore portion, wherein first bore portion 54*a* has a first diameter and second bore portion 54*b* has a second diameter larger than first bore portion 54*a*. First and second bore portions 54*a*, 54*b* are coaxially aligned along a longitudinal single axis of stepped bore 54.

At least one aperture 58, preferably two apertures 58 as shown in the example of FIG. 2, extend radially through body 52 into second bore portion 54*b*. Apertures 58 may aligned 180° diametrically opposite each other on opposite sides of body 52. Apertures 58 are arranged to operatively connect to conduits 40*a* to direct a flow of water into stepped bore 54 and into nozzle sleeve 100, as discussed below. Apertures 58 may, for example, receive the ends of conduits 40*a* therein. If fewer than all of the apertures 58 are connected to conduits 40*a*, a plug or other closure member (not shown) may close any of the apertures 58 that are not operatively connected to a conduit 40*a*.

Cap flange 70 covers the second end of stepped bore 54 and retains nozzle sleeve 100 operatively disposed within stepped bore 54. Cap flange 70 is connected to the top surface of body 52, for example, with fasteners or welds. Cap flange 70 preferably forms a fluid tight seal against body 52 to prevent cooling water and/or atomizing steam from escaping through the second end of stepped bore 54. Thus, a seal 72, such as a gasket or O-ring, is sealingly disposed between cap flange 70 and the top surface of body 52. Seal 72 is disposed in an annular groove 64 formed in the top surface of body 52 adjacent second bore portion 54*c*.

At least one aperture 74 extends radially through cap flange 70 and is in fluid communication with inlets 110 of nozzle sleeve 100, as discussed in more detail below. Aperture 74 in cap flange 70 is angularly offset from apertures 58 in body 52, preferably orthogonally. Aperture 74 is arranged to operatively connect to conduit 40*b* to direct a flow of steam into stepped bore 54 and into nozzle sleeve 100, as discussed below. Aperture 74 may, for example, receive the end of conduit 40*b* therein.

Nozzle sleeve 100 is received within stepped bore 54 of body 52 and is secured within stepped bore 54 by cap flange 70. Nozzle sleeve 100 can be manufactured using Additive Manufacturing Technology, such as direct metal laser sintering, full melt powder bed fusion, laser powder bed fusion, etc., which allows nozzle sleeve 100 to be manufactured as a single, solid, unitary piece, which reduces the manufacturing lead time, complexity, and cost. Using an Additive Manufacturing Technology process, the 3-dimensional CAD file of nozzle sleeve 100 is sliced/divided into multiple layers. For example layers approximately 20-60 microns thick. A powder bed, such as a powder based metal, is then laid down representing the first layer of the design and a laser or electron beam sinters together the design of the first layer. A second layer of powder, representing the second layer of the design, is then laid down over the first sintered layer. The second layer of powder is then sintered/fused together with the first layer. This continues layer after layer to form the completed nozzle sleeve 100. Using an Additive Manufacturing Technology process to manufacture nozzle sleeves for spray nozzle assemblies allows the freedom to produce passages having various shapes and geometries, and other feature described below, that are not possible using current standard casting or drilling techniques. As discussed above, the solid, unitary body of the nozzle sleeve also increases the thermal fatigue resistance.

Figure 3:
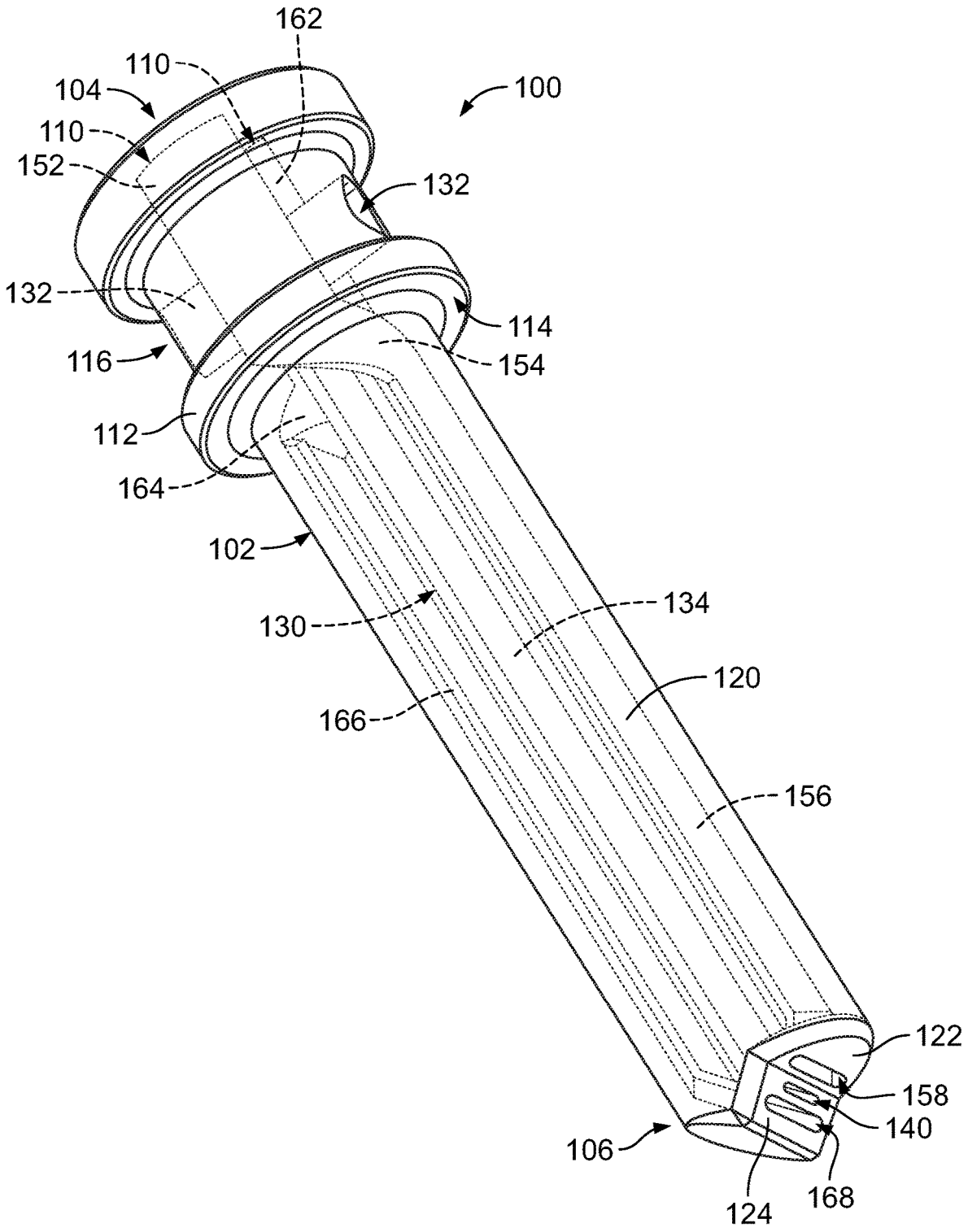
FIG. 3 is an isometric view of an example nozzle sleeve of the spray nozzle assembly of FIG. 2 with the internal water and steam passages shown in phantom.
Figure 4:
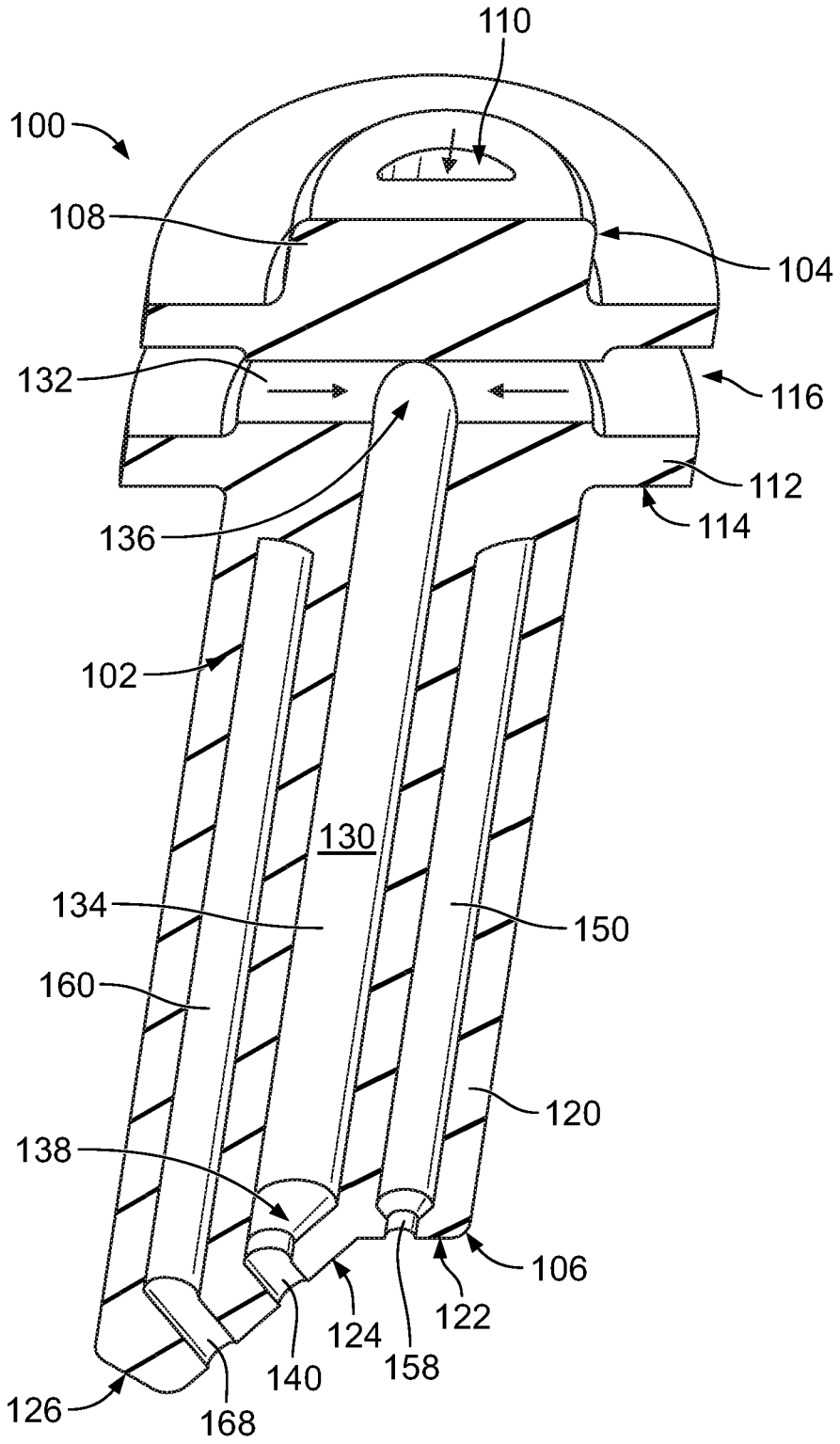
FIG. 4 is an isometric cross-sectional view of the nozzle sleeve of FIG. 3.

As shown in FIGS. 2-4, one example nozzle sleeve 100 generally includes a solid, unitary, cylindrical body 102 that extends from a first end 104 to a second end 106 and defines an upper section 108 at the first end 104, a lower section 120 at the second end 106, and a middle section 112 disposed between upper section 108 and lower section 120. Alternatively, nozzle sleeve 100 could include only middle section 112 and lower section 120 and be completely disposed within body 52 of housing 50. Lower section 120 of nozzle sleeve 100 is disposed in first bore portion 54*a* of body 52, middle section 112 is disposed in second bore portion 54*b*, and upper section 108 is disposed in a cavity 76 formed in cap flange 70. Middle section 112 has an outside diameter that is greater than the outside diameters of upper section 108 and lower section 120 to form a radially extending annular shoulder 114 that forms a radial seating surface. Annular shoulder 114 is operatively seated directly or indirectly against annular step 56 to maintain middle section 112 of nozzle sleeve 100 within second bore portion 54*b*. An annular groove 116 extends circumferentially around the outer diameter surface of middle section 112 and is axially spaced between a top end of middle section 112 and annular shoulder 114. The outside diameter of middle section 112 corresponds to the inside diameter of second bore portion 54*b* to provide a tight slip fit therewith. Lower section 120 of nozzle sleeve 100 extends beyond the first end of stepped bore 54 and neck 60 and into ring body 32 when spray nozzle assembly 34 is installed. Lower section 120 terminates at second end 106 of nozzle sleeve 100 and, in the example shown, second end 106 includes first, second, and third surfaces 122, 124, 126. First surface 122 is planar and extends generally perpendicular to the longitudinal axis of nozzle sleeve 100. Second surface 124 is planar and extends away from first surface 122 at an angle and at an acute angle $\alpha$ to the longitudinal axis of nozzle sleeve. Third surface 126 is planar and extends away from second surface 124 at an angle. Alternatively, third surface 126 can be removed and second end 106 of nozzle sleeve 100 can include only first and second surfaces 122, 124.

A first fluid passage 130, which in the example shown allows the flow of cooling water through nozzle sleeve 100, is formed through body 102 and includes a first section 132 and a second section 134. First section 132 extends radially across middle section 112 of body such that first section 132 is in fluid communication with annular groove 116. Second section 134 extends axially along body 102, preferably coaxial with the longitudinal axis of nozzle sleeve 100, and has a first end 136 that is in fluid communication with first section 132 and is spaced apart from first end 104 of body 102. A second end 138 of second section 134, opposite first end 136, is in fluid communication with exit aperture 140, which is formed through second surface 124 of second end 106 to discharge the cooling water into ring body 32. In the example shown, exit aperture 140 is an elongated slot that is generally linear and extends across second surface 124.

Second and third fluid passages 150, 160, which in the example shown allow the flow of atomizing steam through nozzle sleeve 100, are also formed through body 102 and each include first, second, and third sections 152, 154, 156 and 162, 164, 166, respectively. First sections 152, 154 of second and third fluid passages 150, 160 are in fluid communication with inlets 110 to allow the delivery of atomizing steam from conduits 40*b* into second and third fluid passages 150, 160 and first sections 152, 154 extend generally parallel to the longitudinal axis of nozzle sleeve 100. In the example shown, first sections 152, 154 have a generally semi-circular cross-section and extend longitudinally on opposite sides of first fluid passage 130. Third sections 156, 166 of second and third fluid passages 150, 160 extend generally parallel to the longitudinal axis of nozzle sleeve 100 and, in the example shown, also have a generally semi-circular cross-section. Third sections 156, 166 are in fluid communication with first sections 152, 162 through second sections 154, 164, extend longitudinally on opposite sides of first fluid passage 130, and are orthogonally radially offset from first sections 152, 162. Third section 156 of second fluid passage 150 is in fluid communication with exit aperture 158, which is formed through first surface 122 of second end 106 to discharge atomizing steam into ring body 32 on one side of exit aperture 140. Third section 166 of third fluid passage 160 is in fluid communication with exit aperture 158, which is formed through second surface 124 of second end 106 to discharge atomizing steam into ring body 32 on a second side of exit aperture 158, opposite exit aperture 158. By discharging atomizing steam through exit apertures 158, 168 on opposite sides of the cooling water discharge at exit aperture 140, the cooling water is "jacketed" between two jets of atomizing steam, which ensures that all of the water is effectively atomized and no water is "bounced away" and escapes the steam jets.

As can best be seen in FIG. 3, a spiral, helix, or compound angle design of second and third fluid passages 150, 160 (used for the flow of atomizing steam through nozzle sleeve 100) is used to offset the flow of cooling water and atomizing steam, to change the orientation of second and third fluid passages 150, 160 inside nozzle sleeve 100 between inlets 110 and exit apertures 158, 168. The same concept can also be used to switch which fluid passages are nested. For example, if the steam passage extended axially through the nozzle sleeve at the inlet and the cooling water passages were radially offset from and positioned on either side of the steam passage, the water and steam passages could stop somewhere along the nozzle sleeve, then a double helix, spiral, or compound angles, could be used to reroute the inner steam passage in a sweeping fashion to be on the outside and to reroute the outer water passage bore to the inside.

Figure 5:
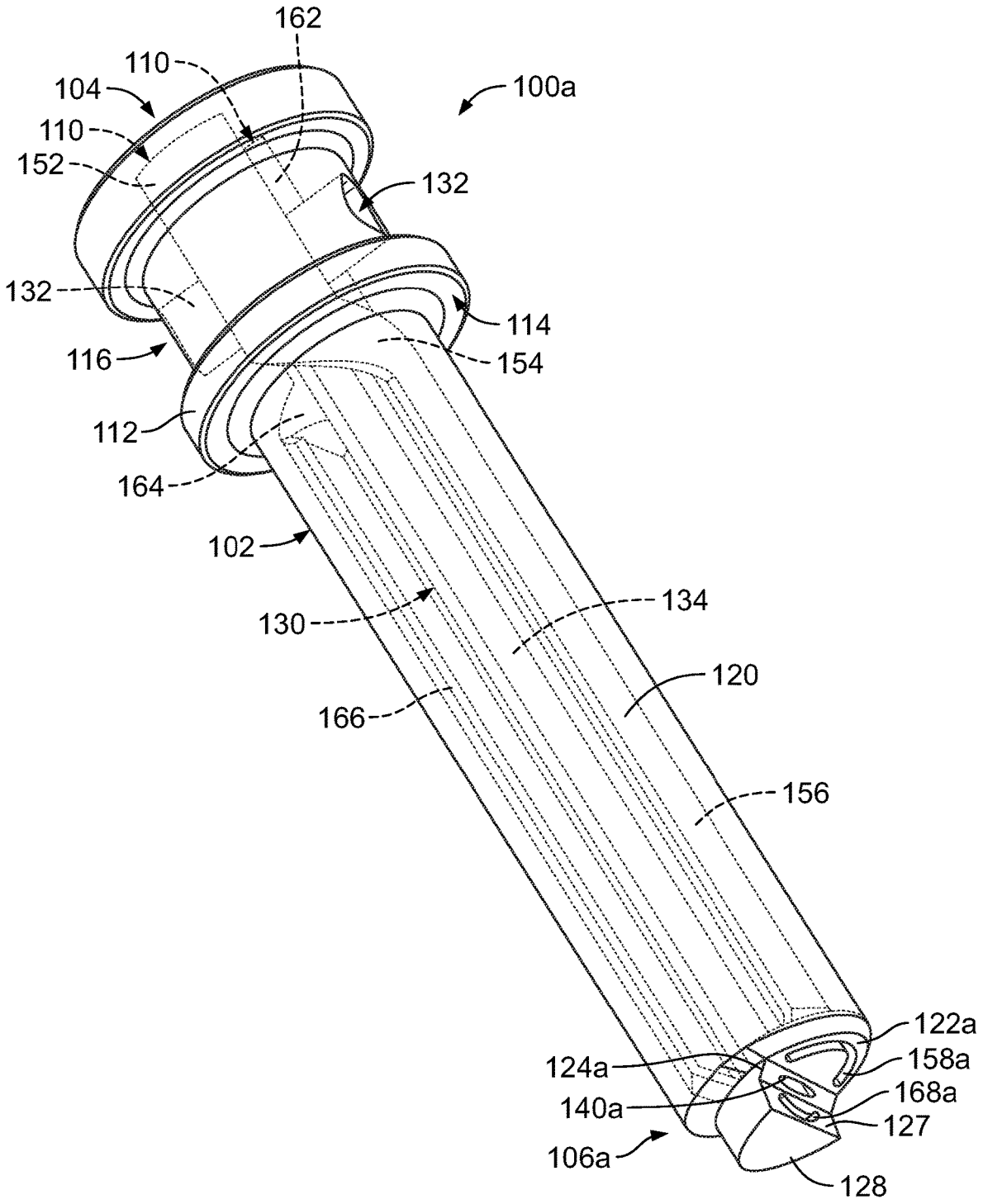
FIG. 5 is an isometric view of another example nozzle sleeve that can be used in the spray nozzle assembly of FIG. 2 with the internal water and steam passages shown in phantom.
Figure 6:
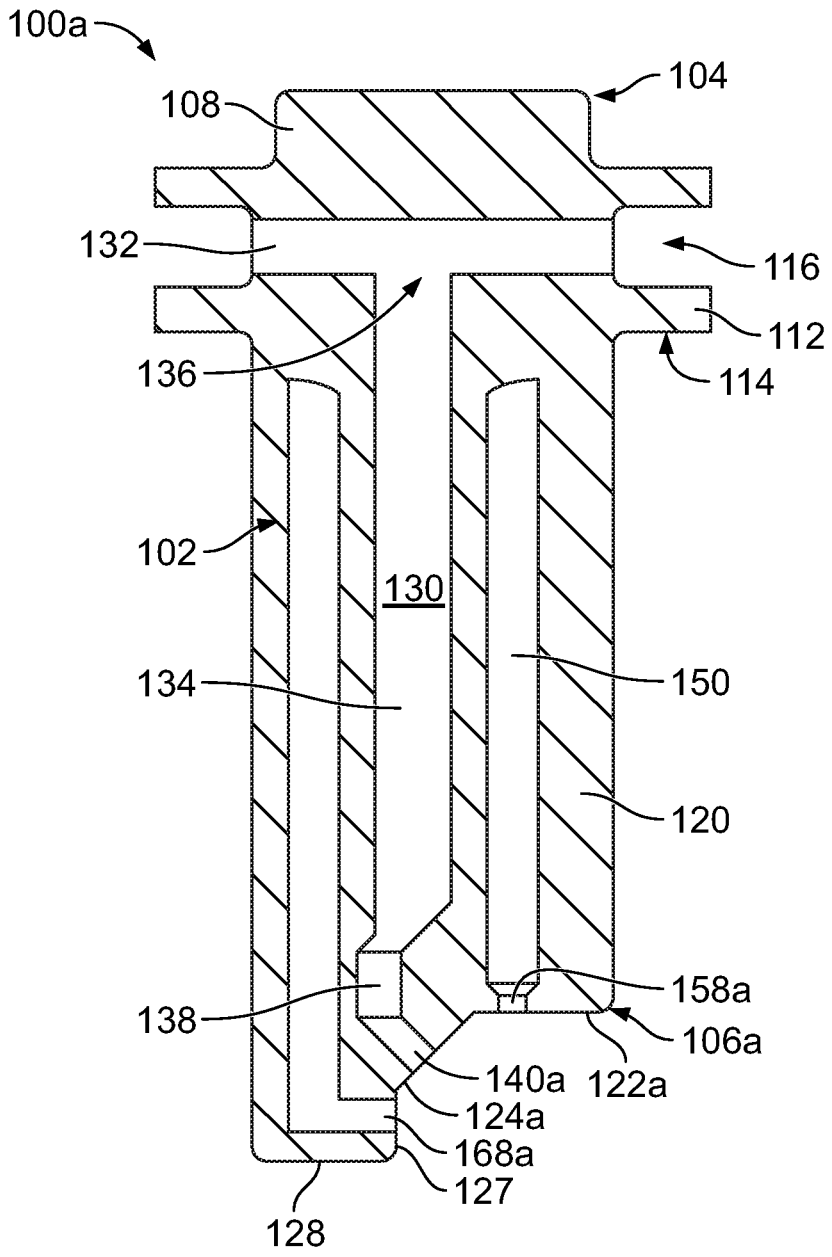
FIG. 6 is a cross-sectional view of the nozzle sleeve of FIG. 5.

Referring to FIGS. 5-6, another example nozzle sleeve 100A is shown that can also be used with spray nozzle assemblies 34. Nozzle sleeve 100A is identical to nozzle sleeve 100, except that second end 106A of nozzle sleeve 100A includes first, second, third, and fourth surfaces 122A, 124A, 127, 128. First surface 122A is planar and extends generally perpendicular to the longitudinal axis of nozzle sleeve 100A. Second surface 124A is planar and extends away from first surface 122A at an angle and at an acute angle $\alpha$ to the longitudinal axis of nozzle sleeve. Third surface 127 is planar and extends away from second surface 124A at an angle and generally parallel to the longitudinal axis of nozzle sleeve 100A. Finally, fourth surface 128 is generally planar and extends generally perpendicular to third surface 127 and to the longitudinal axis of nozzle sleeve 100A. In this example, exit aperture 158A (discharging atomizing steam) is formed through first surface 122A, exit aperture 140A (discharging cooling water) is formed through second surface 124A, and exit aperture 168A (atomizing steam) is formed through third surface 127. In addition, rather than being generally linear slots, exit apertures 158A, 168A are arcuate slots that curve around exit aperture 140A and exit aperture 140A is elliptical. The arcuate shapes of exit apertures 158A and 168A and the angling of the discharge of the atomizing steam from exit aperture 168A with respect to the discharge of cooling water from exit aperture 140A can be used to further "jacket" the cooling water with the atomizing steam.

Figure 7:
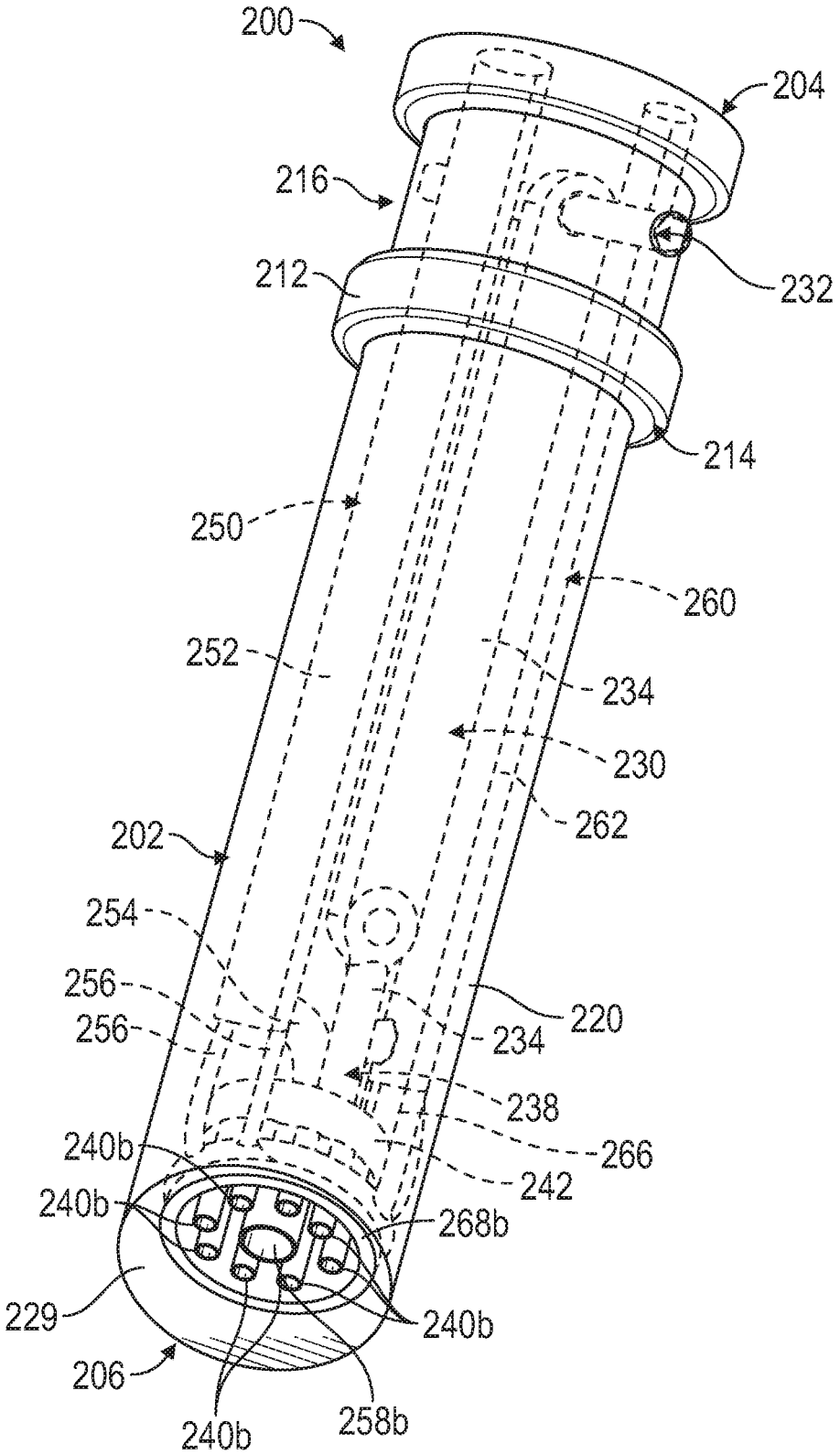
FIG. 7 is a front isometric view of another example nozzle sleeve that can be used in the spray nozzle assembly of FIG. 2 with the internal water and steam passages shown in phantom.

Referring to FIG. 7, another example nozzle sleeve 200 is shown that can also be used with spray nozzle assemblies 34. Like nozzle sleeve 100, nozzle sleeve 200 can be manufactured using Additive Manufacturing Technology and generally includes a solid, unitary, cylindrical body 202 that extends from a first end 204 to a second end 206 and defines an upper section 208 (not shown) (like upper section 108) at first end 204, a lower section 220 at second end 206, and a middle section 212 disposed between upper section 208 and lower section 220. Alternatively, nozzle sleeve 200 could include only middle section 212 and lower section 220 and be completely disposed within body 52 of housing 50. Lower section 220 of nozzle sleeve 200 is disposed in first bore portion 54*a* of body 52, middle section 212 is disposed in second bore portion 54*b*, and upper section 208 is disposed in a cavity 76 formed in cap flange 70. Middle section 212 has an outside diameter that is greater than the outside diameters of upper section 208 and lower section 220 to form a radially extending annular shoulder 214 that forms a radial seating surface. Annular shoulder 214 is operatively seated directly or indirectly against annular step 56 to maintain middle section 212 of nozzle sleeve 200 within second bore portion 54*b*. An annular groove 216 extends circumferentially around the outer diameter surface of middle section 212 and is axially spaced between a top end of middle section 212 and annular shoulder 214. The outside diameter of middle section 212 corresponds to the inside diameter of second bore portion 54*b* to provide a tight slip fit therewith. Lower section 220 of nozzle sleeve 200 extends beyond the first end of stepped bore 54 and neck 60 and into ring body 32 when spray nozzle assembly 34 is installed. Lower section 220 terminates at second end 206 of nozzle sleeve 200 and, in the example shown, second end 206 includes a planar surface 229 that extends at an angle to the longitudinal axis of nozzle sleeve 200.

A first fluid passage 230, which in the example shown allows the flow of cooling water through nozzle sleeve 200, is formed through body 202. First fluid passage 230 includes a first section 232 that extends radially across middle section 212 of body 202, like first section 132 of first fluid passage 130, such that first section 232 is in fluid communication with annular groove 216. A second section 234 of first fluid passage 230 extends axially along body 202, preferably coaxial with the longitudinal axis of nozzle sleeve 200. Second section 234 extends from a first end 236 (not shown), that is in fluid communication with first section 232 and is spaced apart from first end 204 of body 202, to a second end 238, opposite first end 236, which is in fluid communication with an annular section 242. Annular section 242 is a generally ring shaped passage that extends annularly within body 202 and is in fluid communication with a plurality of exit apertures 240B, which are formed through planar surface 229 of second end 206 and are positioned in a generally circular pattern to discharge the cooling water into ring body 32.

Second and third fluid passages 250, 260, which in the example shown allow the flow of atomizing steam through nozzle sleeve 200, are also formed through body 202. First sections 252, 262 of each of the second and third fluid passages 250, 260, respectively, are in fluid communication with inlets 210 (not shown) (same as inlets 110) to allow the delivery of atomizing steam from conduits 40*b* into second and third fluid passages 250, 260. In the example shown, first sections 252, 262 are generally semi-circular in shape and extend generally parallel to the longitudinal axis of nozzle sleeve 200 on opposite sides of second section 234 of first fluid passage 130. Second sections 254, 264 of second and third fluid passages 250, 260 extend radially inward from respective first sections 252, 262, turn approximately 90 degrees to run axially along nozzle sleeve 200, and merge together to pass through the center of annular section 242. Once merged, the merged portions of sections 254, 264 are both in fluid communication with exit aperture 258, which is formed through planar surface 229 of second end 206 to discharge atomizing steam into ring body 32 in the center of the circular pattern formed by exit apertures 240B. Third sections 256, 266 of second and third fluid passages 250, 260 extend longitudinally from respective first sections 252, 262 and are each in fluid communication with exit aperture 268B to discharge atomizing steam into ring body 32. In the example shown, exit aperture 268B is an annular, ring-shaped aperture that surrounds the circular pattern formed by exit apertures 240. By discharging atomizing steam through exit apertures 258B, 268B on opposite sides of the cooling water discharge at exit apertures 240B, the cooling water is "jacketed" between two jets of atomizing steam, which ensures that all of the water is effectively atomized and no water is "bounced away" and escapes the steam jets.

The example nozzle sleeve 200 shown in FIG. 7, utilizes similar upper nozzle sleeve geometries as nozzle sleeve 100 for water and steam inlets, but leads to mixing of a central steam jet through exit aperture 258B, water hole jets at exit apertures 240B, and outer enveloping steam cone jet external to nozzle sleeve 200. The water is injected through the holes between both steam areas to ensure better mixing and complete atomization of the cooling water, which allows for minimal wear on nozzle sleeve 200 due to external steam/water mixing and no moving parts.

Figure 8:
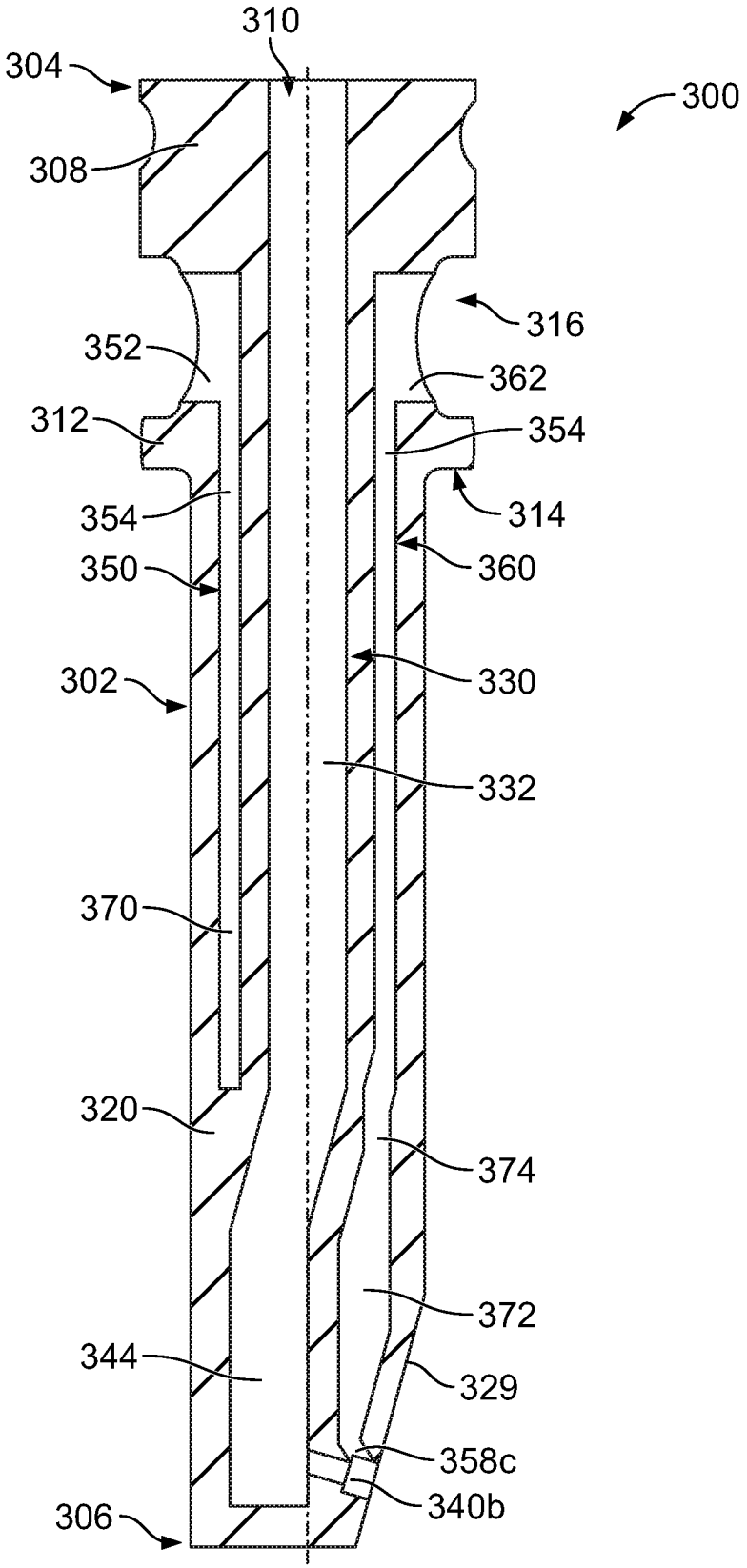
FIG. 8 is a side cross-sectional view of another example nozzle sleeve that can be used in the spray nozzle assembly of FIG. 2.
Figure 9:
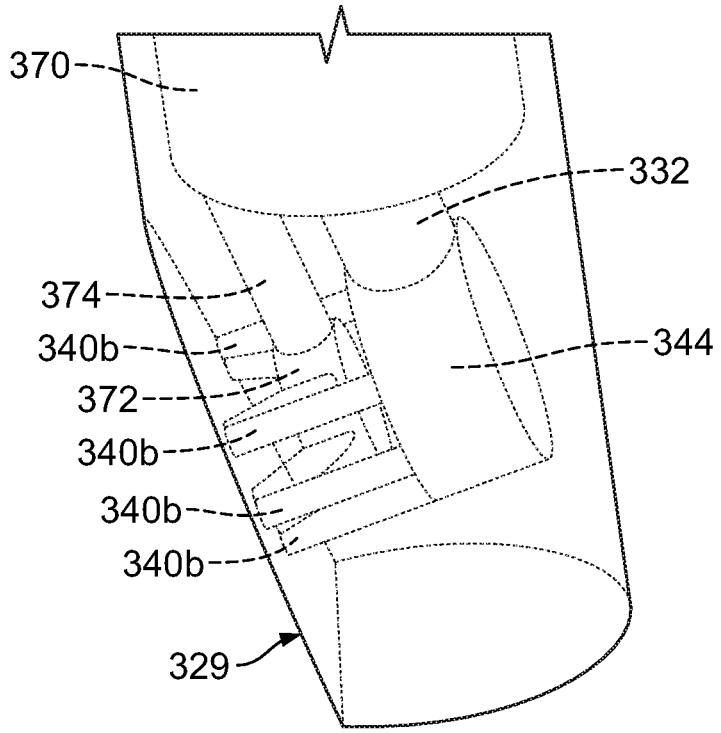
FIG. 9 is a partial side isometric view of the nozzle sleeve of FIG. 8 showing the internal water and steam passages in phantom.
Figure 10:
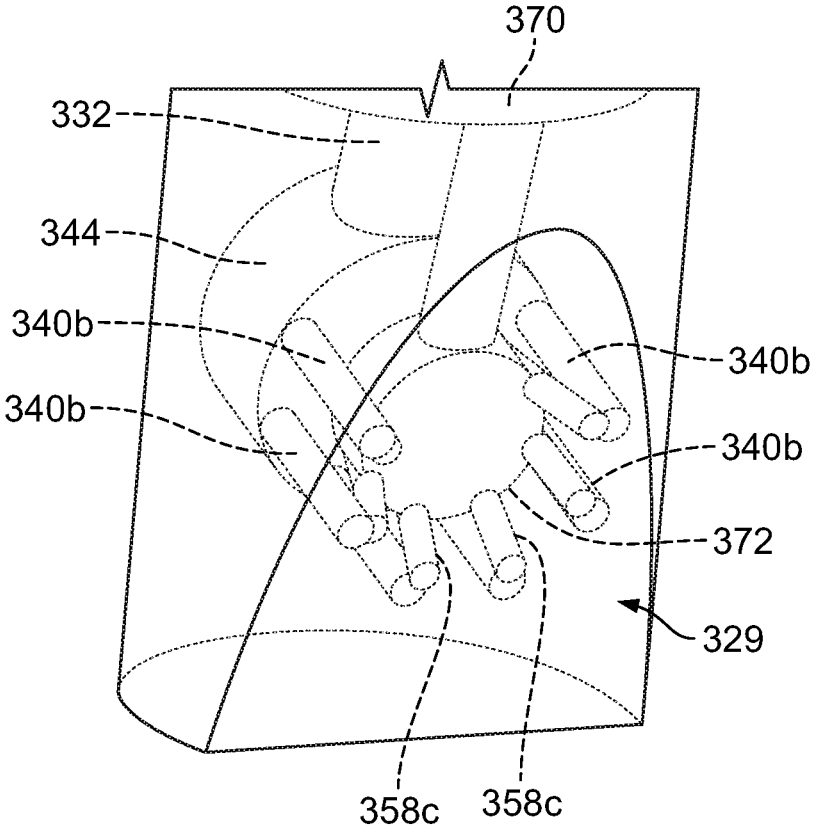
FIG. 10 is partial front isometric view of the nozzle sleeve of FIG. 8 showing the internal water and steam passages in phantom.

Referring to FIGS. 8-10, another example nozzle sleeve 300 is shown that can also be used with spray nozzle assemblies 34. Like nozzle sleeve 100, nozzle sleeve 300 can be manufactured using Additive Manufacturing Technology and generally includes a solid, unitary, cylindrical body 302 that extends from a first end 304 to a second end 306 and defines an upper section 308 at first end 304, a lower section 320 at second end 306, and a middle section 312 disposed between upper section 308 and lower section 320. Lower section 320 of nozzle sleeve 300 is disposed in first bore portion 54*a* of body 52, middle section 312 is disposed in second bore portion 54*b*, and upper section 308 is disposed in a cavity 76 formed in cap flange 70. Middle section 312 has an outside diameter that is greater than the outside diameter of lower section 320 to form a radially extending annular shoulder 314 that forms a radial seating surface. Annular shoulder 314 is operatively seated directly or indirectly against annular step 56 to maintain middle section 312 of nozzle sleeve 300 within second bore portion 54*b*. An annular groove 316 extends circumferentially around the outer diameter surface of middle section 312 and is axially spaced between a top end of middle section 312 and annular shoulder 314. The outside diameter of middle section 312 corresponds to the inside diameter of second bore portion 54*b* to provide a tight slip fit therewith. Lower section 320 of nozzle sleeve 300 extends beyond the first end of stepped bore 54 and neck 60 and into ring body 32 when spray nozzle assembly 34 is installed. Lower section 320 terminates at second end 306 of nozzle sleeve 300 and, in the example shown, second end 306 includes a planar surface 329 that extends at an angle to the longitudinal axis of nozzle sleeve 300.

A first fluid passage 330, which in the example shown allows the flow of atomizing steam through nozzle sleeve 300, is formed through body 302. First fluid passage 330 includes a first section 332 that is in fluid communication with an inlet 310 in first end 304 of body 302 and extends axially along body 302, preferably coaxial with the longitudinal axis of nozzle sleeve 300. First section 332 is in fluid communication with a first disk shaped cavity 344, which is offset from the longitudinal axis of nozzle sleeve 300 to provide space for second disk shaped cavity 372, discussed in more detail below. Cavity 344 is in fluid communication with a plurality of exit apertures 340B, which are formed through planar surface 329 of second end 306 and are positioned in a generally circular pattern.

Second and third fluid passages 350, 360, which in the example shown allow the flow of cooling water through nozzle sleeve 300, are also formed through body 302. Second and third fluid passages 350, 360 each have a first section 352, 362 that extends radially into middle section 312 of body 302 and are in fluid communication with annular groove 316. Second sections 354, 364 of second and third fluid passage 350, 360 extend parallel to longitudinal axis of nozzle sleeve 300 and are in fluid communication with first sections 352, 362. Second sections 354, 364 of second and third fluid passages 350, 360 are in fluid communication with and flow into annular cavity 370, which is formed in body 302 around first section 332 of first fluid passage 330. Annular cavity 370 is also in fluid communication with a second disk shaped cavity 372, for example through a cylindrical fluid passage section 374. Cavity 372 is in fluid communication with a plurality of exit apertures 358C, which are also positioned in a generally circular pattern such that each exit aperture 358C intersects a corresponding exit aperture 340B within body 302 to mix the cooling water and atomizing steam within body 302 of nozzle sleeve 300.

Nozzle sleeve 300, shown in FIGS. 8-10, has internal mixing of the atomizing steam and cooling water, via a disk of water created by exit apertures 340B set in front of the exit apertures 358C, which deliver the atomized steam. The cooling water is provided to nozzle sleeve 300 through the sides of nozzle sleeve 300 and the atomizing steam is provided through the top. The cooling water from second sections 354, 364 of second and third fluid passages 350, 360 is merged into cylindrical annular cavity 370 around the steam in first fluid passage 330 until second end 306 of body 302 is approached. Near second end 306, cavity 344 for the atomizing steam is offset to the back of body 302 to allow for space for cavity 370 for the cooling water. The cooling water is channeled to cavity 372 via a sweep that gets thinner and deeper at the same time to allow for flow area to be maintained. Exit apertures 340B and 358C are connected to allow for the cooling water to be atomized. Exit apertures 340B are formed an angle to allow for them to connect to cavity 344 without interfering with exit apertures 358C or cavity 372.

Figure 11:
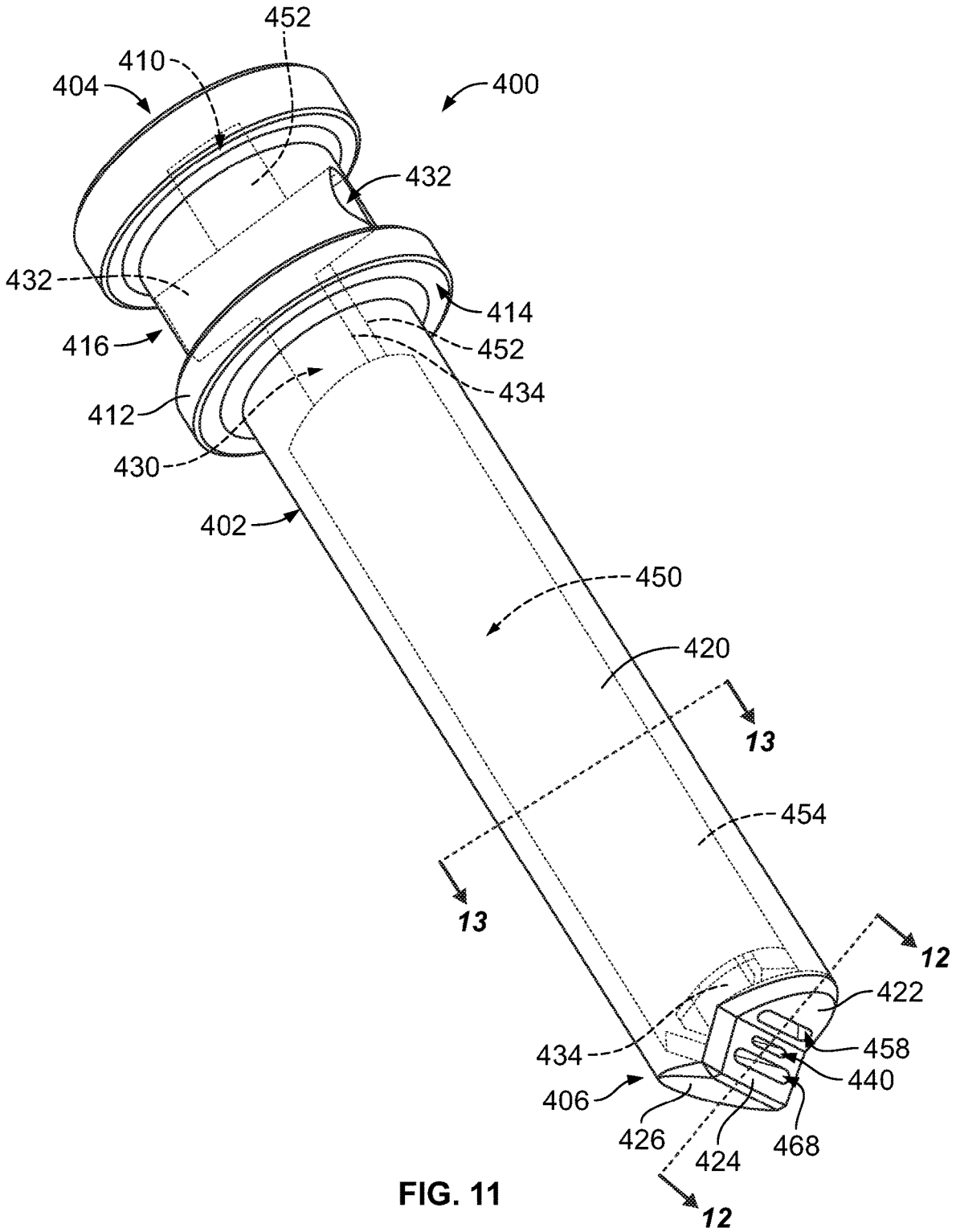
FIG. 11 is an isometric view of another example nozzle sleeve that can be used with the spray nozzle assembly of FIG. 2 with the internal water and steam passage shown in phantom.
Figure 12:
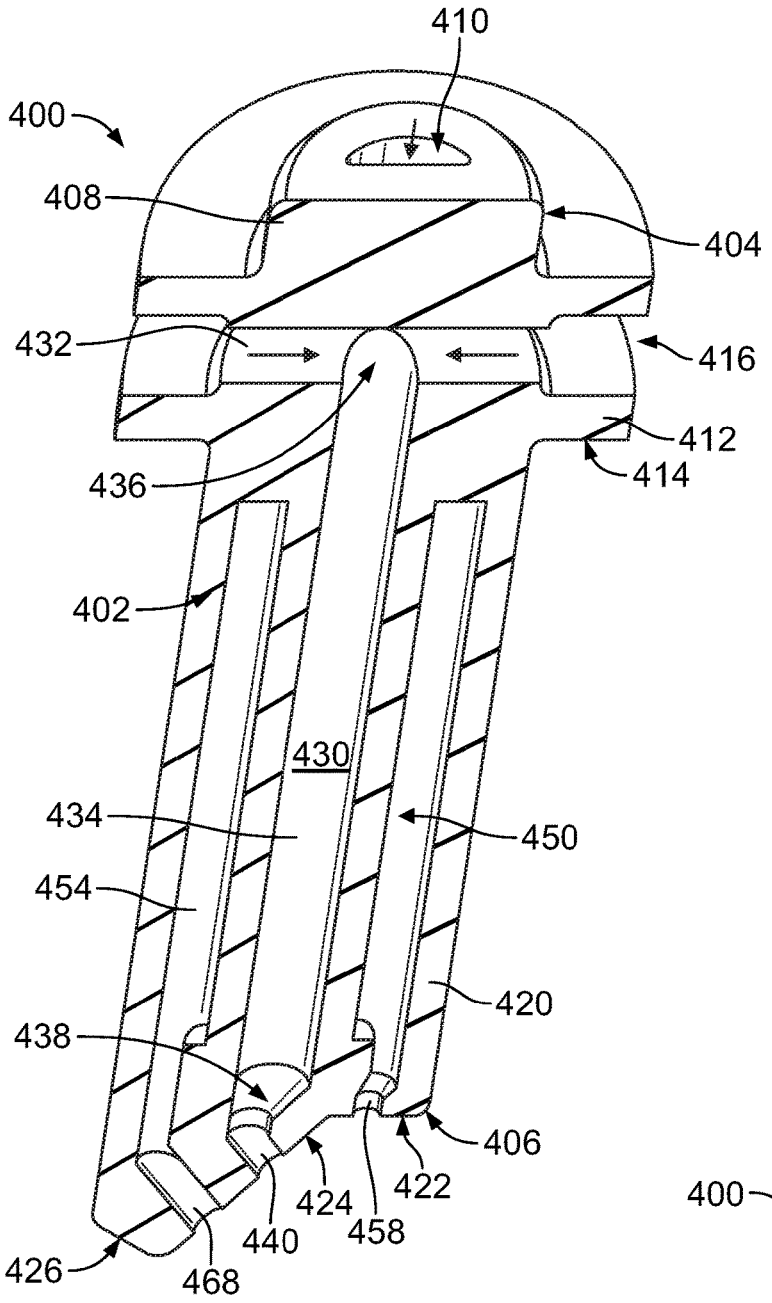
FIG. 12 is an isometric cross-sectional view of the nozzle sleeve of FIG. 11 taken along line 12-12 of FIG. 11.
Figure 13:
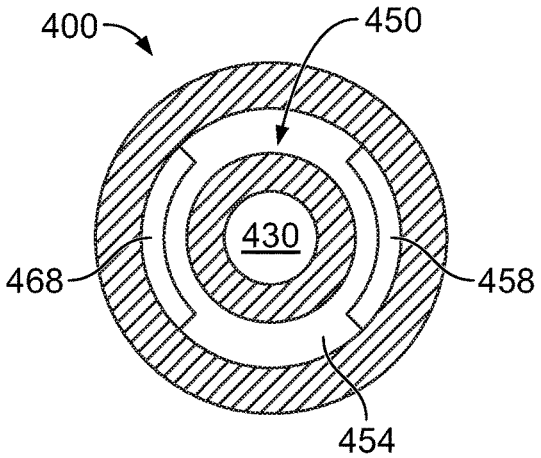
FIG. 13 is a cross-sectional view of the nozzle sleeve of FIG. 11 taken along line 13-13 of FIG. 11.

Referring to FIGS. 11-13, another example nozzle sleeve 400 is shown that can also be used with spray nozzle assemblies 34. Nozzle sleeve 400 generally includes a solid, unitary, cylindrical body 402 that extends from a first end 404 to a second end 406 and defines an upper section 408 at the first end 404, a lower section 420 at the second end 406, and a middle section 412 disposed between upper section 408 and lower section 420. Alternatively, nozzle sleeve 100 could include only middle section 412 and lower section 420 and be completely disposed within body 52 of housing 50. Lower section 420 of nozzle sleeve 400 is disposed in first bore portion 54*a* of body 52, middle section 412 is disposed in second bore portion 54*b*, and upper section 408 is disposed in a cavity 76 formed in cap flange 70. Middle section 412 has an outside diameter that is greater than the outside diameters of upper section 408 and lower section 420 to form a radially extending annular shoulder 414 that forms a radial seating surface. Annular shoulder 414 is operatively seated directly or indirectly against annular step 56 to maintain middle section 412 of nozzle sleeve 400 within second bore portion 54*b*. An annular groove 416 extends circumferentially around the outer diameter surface of middle section 412 and is axially spaced between a top end of middle section 412 and annular shoulder 414. The outside diameter of middle section 412 corresponds to the inside diameter of second bore portion 54*b* to provide a tight slip fit therewith. Lower section 420 of nozzle sleeve 400 extends beyond the first end of stepped bore 54 and neck 60 and into ring body 32 when spray nozzle assembly 34 is installed. Lower section 420 terminates at second end 406 of nozzle sleeve 400 and, in the example shown, second end 406 includes first, second, and third surfaces 422, 424, 426. First surface 422 is planar and extends generally perpendicular to the longitudinal axis of nozzle sleeve 400. Second surface 424 is planar and extends away from first surface 422 at an angle and at an acute angle $\alpha$ (FIG. 2) to the longitudinal axis of nozzle sleeve 400. Third surface 426 is planar and extends away from second surface 424 at an angle. Alternatively, third surface 426 can be removed and second end 406 of nozzle sleeve 400 can include only first and second surfaces 422, 424. In addition, third surface 426 can also be a planar surface that extends away from second surface 424 at an angle and generally parallel to the longitudinal axis of nozzle sleeve 400, as shown in FIGS. 5-6.

A first fluid passage 430, which in the example shown allows the flow of cooling water through nozzle sleeve 400, is formed through body 402 and includes a first section 432 and a second section 434. First section 432 extends radially across middle section 412 of body 402 such that first section 432 is in fluid communication with annular groove 416. Second section 434 extends axially along body 402, preferably coaxial with the longitudinal axis of nozzle sleeve 400, and has a first end 436 that is in fluid communication with first section 432 and is spaced apart from first end 404 of body 402. A second end 438 of second section 434, opposite first end 436, is in fluid communication with exit aperture 440, which is formed through second surface 424 of second end 406 to discharge the cooling water into ring body 32. In the example shown, exit aperture 440 is an elongated slot that is generally linear and extends across second surface 424. Alternatively, exit aperture 440 could also be an elliptical aperture, similar to exit aperture 140A in FIG. 5.

Second fluid passage 450, which in the example shown allows the flow of atomizing steam through nozzle sleeve 400, is also formed through body 402 and includes first and second sections 452, 454. First section 452 of second fluid passage 450 is in fluid communication with inlet 410 to allow the delivery of atomizing steam from conduits 40*b* into second fluid passage 450 and first section 452 extends generally parallel to the longitudinal axis of nozzle sleeve 400. Although a single first section 452 and a single inlet 410 are shown, any number of inlets can be used and any corresponding number of section to provide communication between the inlets and second section 454 can be used. In the example shown, first section 452 has a generally semicircular cross-section and extend longitudinally along the side of first fluid passage 430. Second section 454 of second fluid passage 450 is generally cylindrical, extends generally parallel to the longitudinal axis of nozzle sleeve 400, and is in fluid communication with first section 452. Second section 454 of second fluid passage 450 surrounds second section 434 of first fluid passage 430 and is in fluid communication with exit aperture 458, which is formed through first surface 422 of second end 406 to discharge atomizing steam into ring body 32 on one side of exit aperture 440, and with exit aperture 468, which is formed through second surface 424 to discharge atomizing steam into ring body 32 on an opposite side of exit aperture 440. In the example shown, exit apertures 458, 468 are elongated slots that are generally linear and extend across first and second surfaces 422, 424. However, exit apertures 458, 468 could also be arcuately extending slots, similar to exit apertures 158A, 168A in FIG. 5. Alternatively, if third surface 426 extends away from second surface 424 at an angle and generally parallel to the longitudinal axis of nozzle sleeve 400, as described above, exit aperture 468 can be formed through third surface 426, as shown in FIGS. 5-6. By discharging atomizing steam through exit apertures 458, 468 on opposite sides of the cooling water discharge at exit aperture 440, the cooling water is "jacketed" between two jets of atomizing steam, which ensures that all of the water is effectively atomized and no water is "bounced away" and escapes the steam jets.

In addition to the benefits described above, the example nozzles sleeves shown in FIGS. 14-19 and described below can be used to with spray nozzle assemblies 34 address potential thermal expansion concerns and allow for the nozzle sleeves to be printed in one piece and be used with fluids at greatly differing temperatures, while not overstressing the nozzle sleeve due to internal thermal strains.

Figure 14:
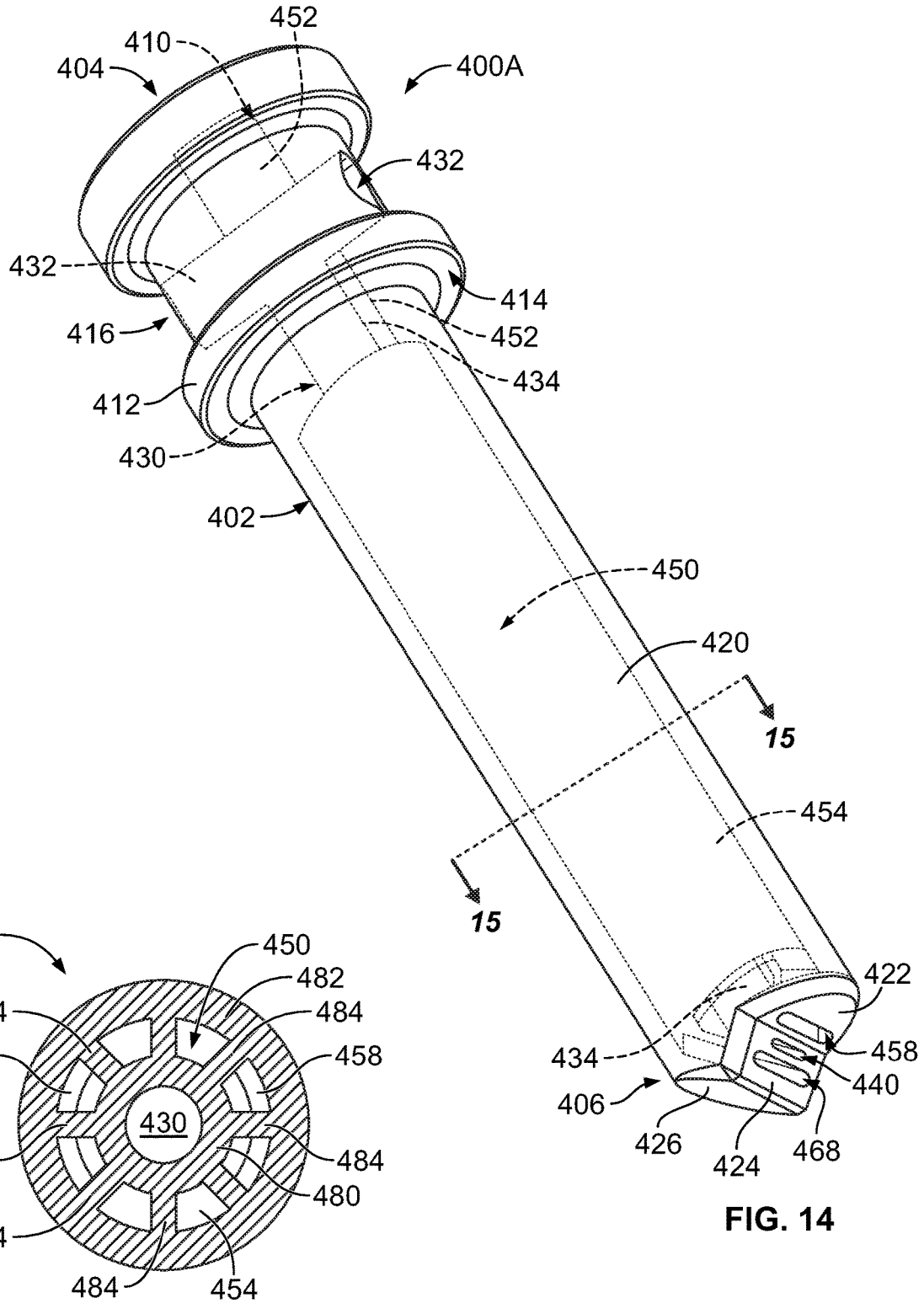
FIG. 14 is an isometric view of another example nozzle sleeve that can be used with the spray nozzle assembly of FIG. 2 with the internal water and steam passage shown in phantom.
Figure 15:
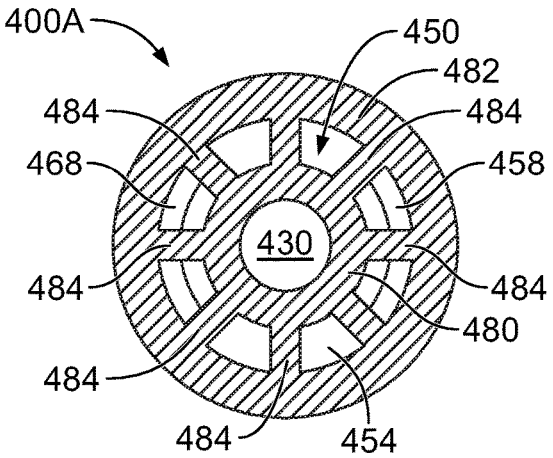
FIG. 15 is a cross-sectional view of the nozzle sleeve of FIG. 14 taken along line 15-15 of FIG. 14.

Referring to FIGS. 14-15, another example nozzle sleeve 400A is shown that can also be used with spray nozzle assemblies 34. Nozzle sleeve 400A is identical to nozzle sleeve 400, except that a plurality of support arms 484, or "fins", extend radially between generally cylindrical inner wall 480, formed between second section 434 of first fluid passage 430 and second section 454 of second fluid passage 450, and generally cylindrical outer wall 482, surrounding second section 454 of second fluid passage 450, along the length of second portion 454 of second fluid passage 454. Heat can conduct through support arms 484 to allow as much thermal conductivity as possible between inner and outer walls 480, 482 to minimize the temperature difference between the inner and outer walls 480, 482. In addition, support arms 484 provide more contact support between inner and outer walls 480, 482 and can distribute the load and reduce localized load points at the ends of inner and outer walls 480, 482.

Figure 16:
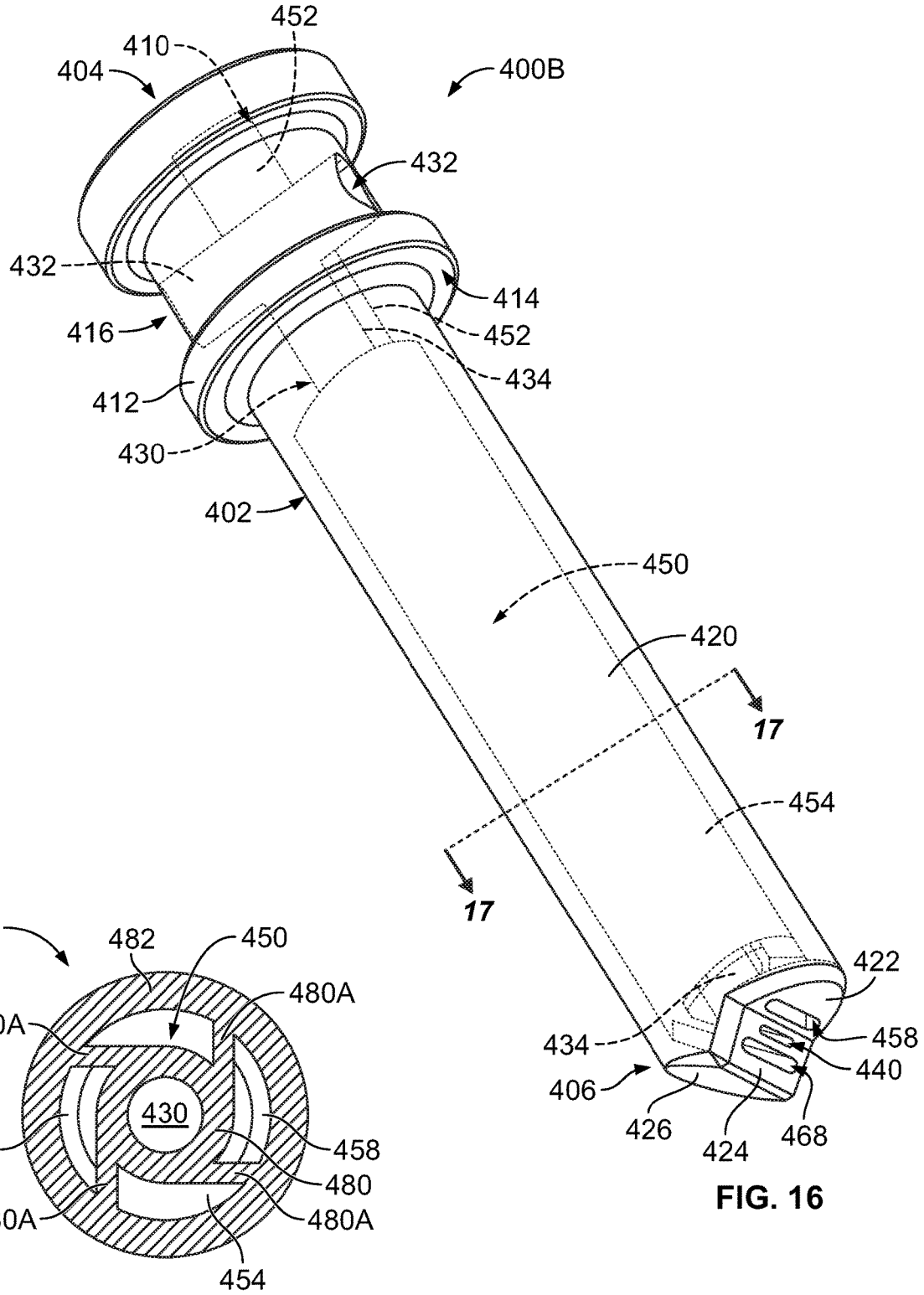
FIG. 16 is an isometric view of another example nozzle sleeve that can be used with the spray nozzle assembly of FIG. 2 with the internal water and steam passage shown in phantom.
Figure 17:
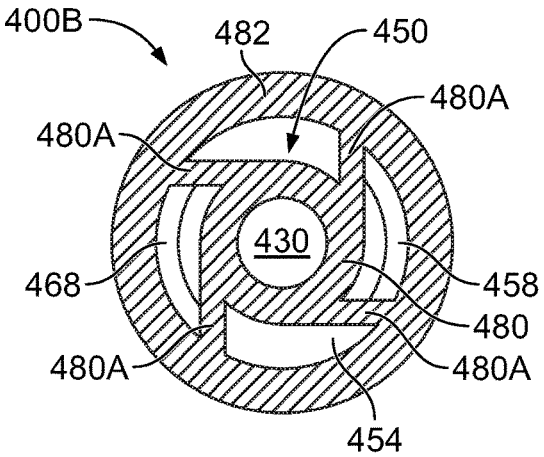
FIG. 17 is a cross-sectional view of the nozzle sleeve of FIG. 16 taken along line 16-16 of FIG. 16.

Referring to FIGS. 16-17, another example nozzle sleeve 400B is shown that can also be used with spray nozzle assemblies 34. Nozzle sleeve 400B is identical to nozzle sleeve 400A, except that support arms 484A in nozzle sleeve 400B extend tangentially from inner wall 480, rather than radially as in nozzle sleeve 400A. As the steam in second fluid passage 450 heats up outer wall 482 and support arms 484A, support arms 484A will lengthen and twist inner wall 480, as well as support arms 484A bending slightly to accommodate the expansion. In addition, although support arms 484A are shown as linear arms, support arms 484A could also be arcuate along the length of inner wall 480 to allow for the expansion of outer wall 482, effectively straightening as nozzle sleeve 400B heats up.

Figure 18:
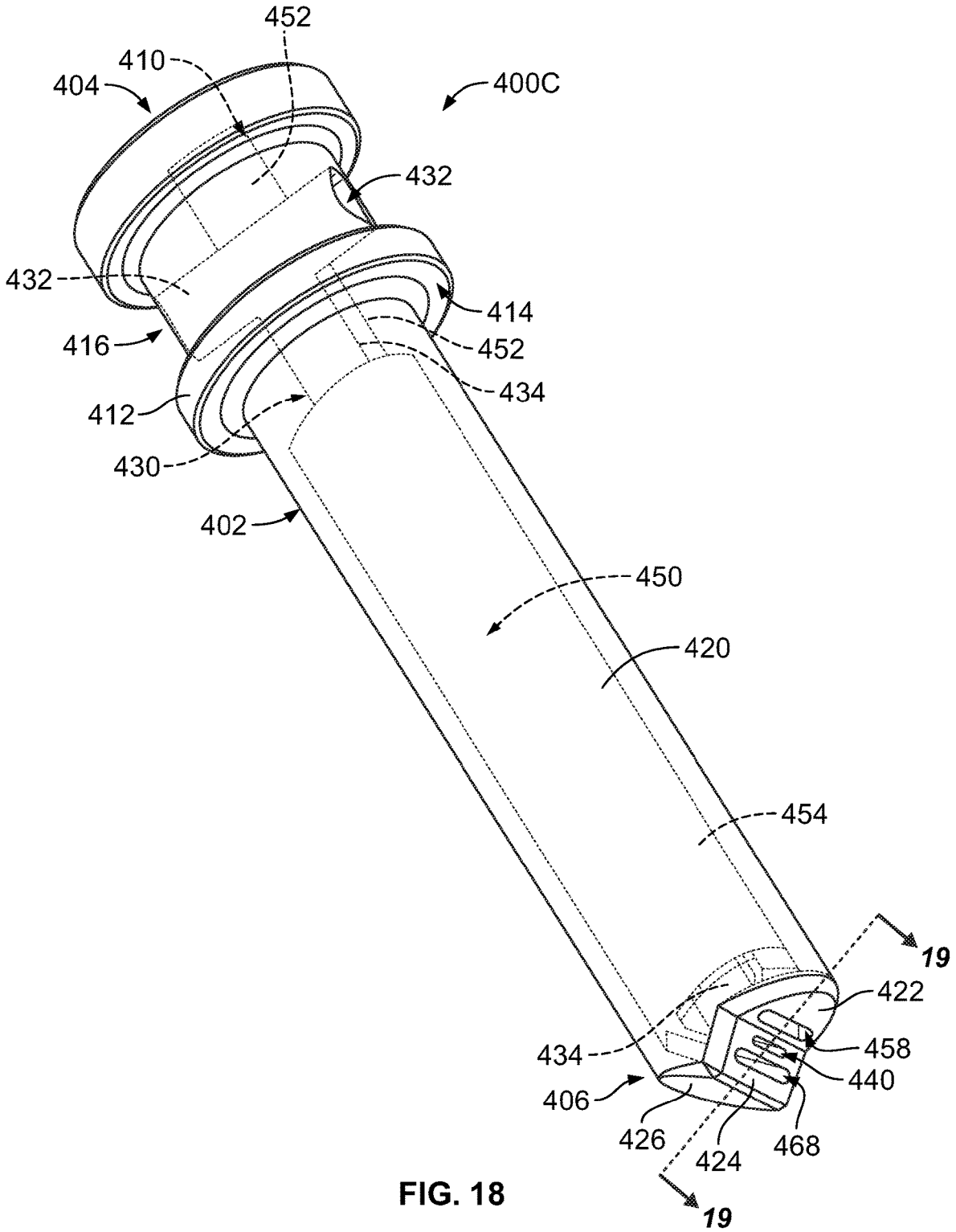
FIG. 18 is an isometric view of another example nozzle sleeve that can be used with the spray nozzle assembly of FIG. 2 with the internal water and steam passage shown in phantom.
Figure 19A:
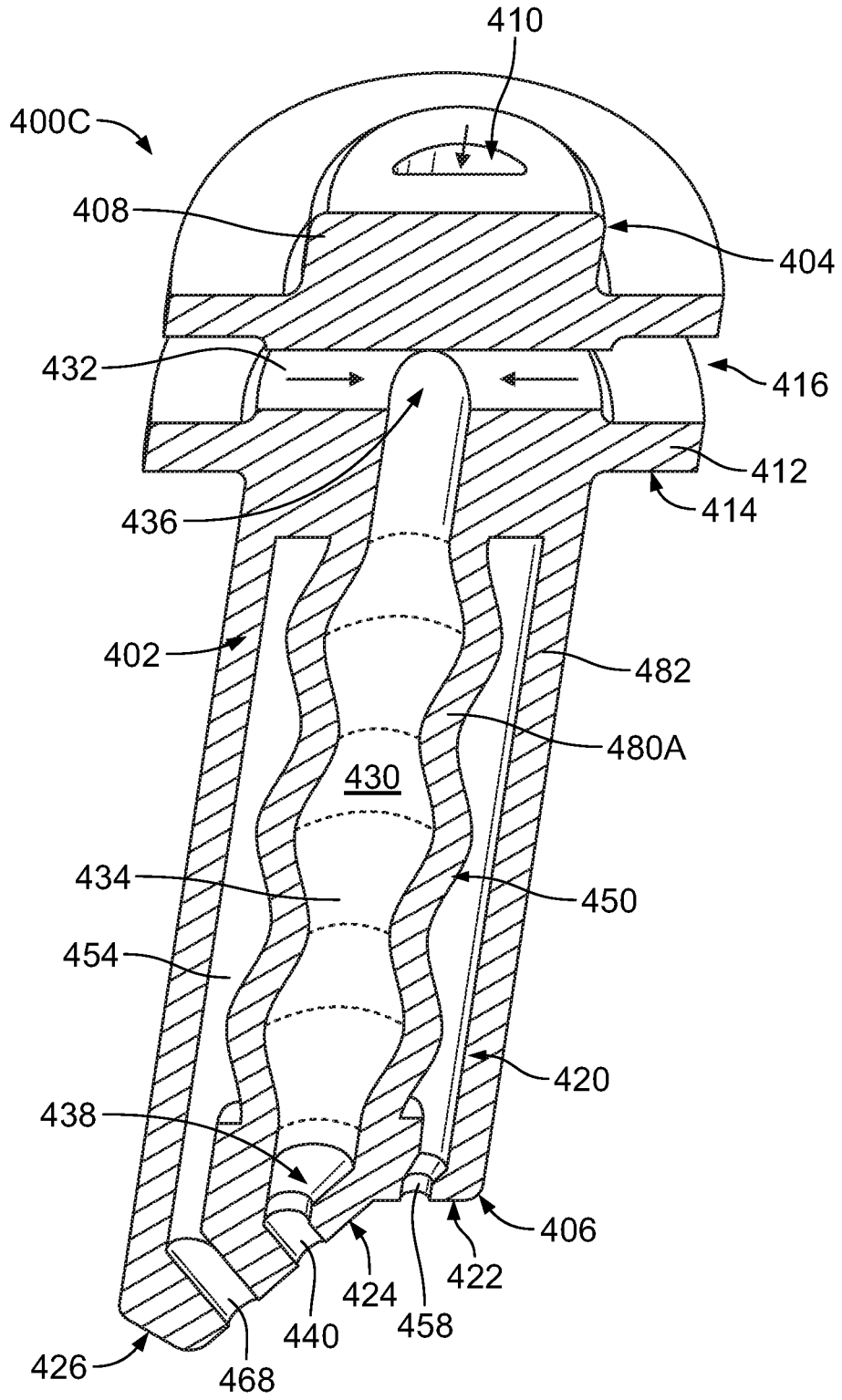
FIG. 19A is an isometric cross-sectional view of one embodiment of the nozzle sleeve of FIG. 18 taken along line 19-19 of FIG. 18.
Figure 19B:
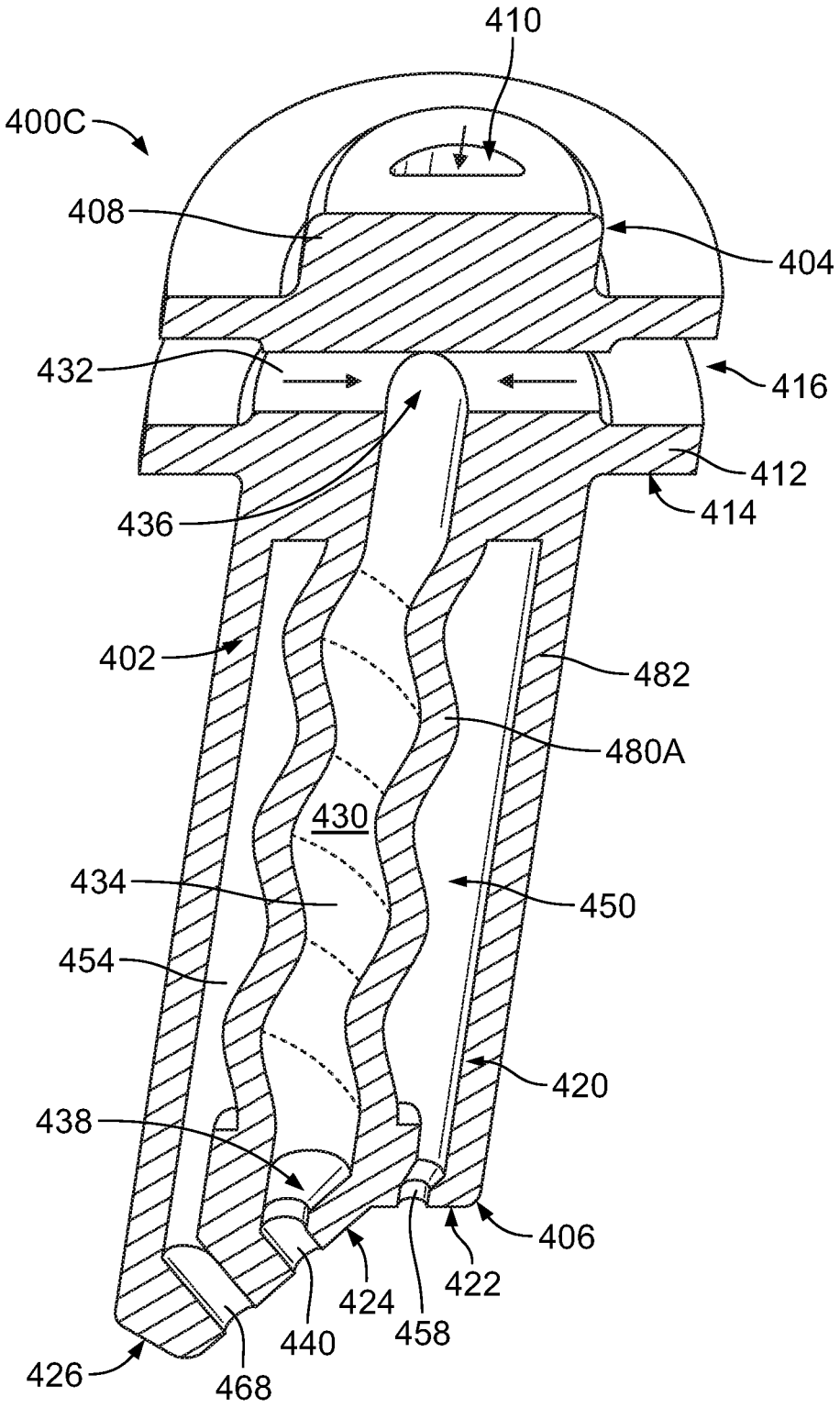
FIG. 19B is an isometric cross-sectional view of an alternate embodiment of the nozzle sleeve of FIG. 18 taken along line 19-19 of FIG. 18.

Referring to FIGS. 18, 19A, and 19B another example nozzle sleeve 400C is shown that can also be used with spray nozzle assemblies 34. Nozzle sleeve 400C is identical to nozzle sleeve 400, except that inner wall 480A between first fluid passage 430 and second fluid passage 450 is corrugated along the length of first fluid passage 430 that is surrounded by second section 454 of second fluid passage 450, forming a type of bellows as the pressure boundary between the fluid in first fluid passage 430 and second fluid passage 450. In the example shown in FIG. 19A, the corrugation of inner wall 480A forms more of a traditional type bellows, where there inner wall 480A is mirrored on opposite sides of the longitudinal axis of first fluid passage 430 and there are multiple peaks and valleys formed by the corrugation that are radially perpendicular to the longitudinal axis. Alternatively, in the example shown in FIG. 19B, the corrugation of inner wall 480A forms more of a spiral type bellows, where there is a single peak and a single valley formed and each forms a type of helix that spirals around the longitudinal axis. The corrugation of inner wall 480A in either manner allows inner wall 480A to stretch as outer wall 482 expands due to thermal expansion from the high temperature steam in second fluid passage 450. Corrugation of inner wall 480A to form more of a spiral type bellows, as shown in FIG. 19B, can also improve the flow capacity of nozzle sleeve 400C. Support arms 484 or support arms 484A described above could also be added to prevent excessive movement of inner wall 480A. Traditionally bellows are fabricated separately and welded into the corresponding assembly. However, in nozzle sleeve 400C, corrugated inner wall 480A is printed as part of nozzle sleeve 400C without the need for additional fabrication welds.

A desuperheater assembly, desuperheater, spray nozzle assemblies, nozzle sleeves, and/or components thereof according the teachings of the present disclosure in some applications are useful for reducing the temperature of superheated steam or other fluids or gases in a fluid pipe to a predefined set point temperature. However, the desuperheater assembly, desuperheater, spray nozzle assemblies, nozzle sleeves, and/or components thereof are not limited to the uses described herein and may be used in other types of arrangements.

The examples described and shown in detail herein are only exemplary of one or more aspects of the teachings of the present disclosure for the purpose of teaching a person of ordinary skill to make and use the invention or inventions recited in the appended claims. Additional aspects, arrangements, and forms of the invention or inventions within the scope of the appended claims are contemplated, the rights to which are expressly reserved.

What is claimed:

1. A spray nozzle assembly for a desuperheater, the spray nozzle assembly comprising:

a housing having a body and a cap flange secured to the body, the body and the cap flange defining a bore within the housing;

a first aperture formed through the body and intersecting the bore;

a second aperture formed through the cap flange and intersecting the bore; and a nozzle sleeve disposed within the bore, the nozzle sleeve comprising:

a solid, unitary sleeve body;

a first fluid passage formed through the sleeve body and in direct fluid communication with the first aperture and with a first exit aperture formed in an end of the sleeve body; and a second fluid passage formed through the sleeve body and in direct fluid communication with the second aperture, with a second exit aperture formed in the end of the sleeve body, and with a third exit aperture formed in the end of the sleeve body; wherein a portion of the second fluid passage surrounds the first fluid passage; and the second and third exit apertures are positioned on opposite sides of the first exit aperture.

2. The spray nozzle assembly of claim 1, wherein the first fluid passage comprises a first section that extends radially across the sleeve body and a second section that intersects the first section and extends longitudinally along the sleeve body.

3. The spray nozzle assembly of claim 1, wherein:

the end of the sleeve body comprises a planar first surface that extends perpendicular to a longitudinal axis of the nozzle sleeve and a planar second surface that extends from the first surface and at an acute angle to the longitudinal axis of the nozzle sleeve;

the second exit aperture is formed through the first surface; and the first and third exit apertures are formed through the second surface.

4. The spray nozzle assembly of claim 1, wherein:

the end of the sleeve body comprises a planar first surface that extends perpendicular to a longitudinal axis of the nozzle sleeve, a planar second surface that extends from the first surface and at an acute angle to the longitudinal axis of the nozzle sleeve, and a planar third surface that extends from the second surface and parallel to the longitudinal axis of the nozzle sleeve;

the second exit aperture is formed through the first surface;

the first exit aperture is formed through the second surface; and the third exit aperture is formed through the third surface.

5. The spray nozzle assembly of claim 1, wherein the first, second, and third exit apertures are linearly extending slots.

6. The spray nozzle assembly of claim 1, wherein the first exit aperture is elliptical and the second and third exit apertures are arcuately extending slots.

7. A desuperheater including the spray nozzle assembly of claim 1, the desuperheater comprising:

a ring body defining an axial flow path;

a plurality of the spray nozzle assemblies disposed around the ring body;

a water manifold connected to each of the spray nozzle assemblies for providing cooling water to each of the spray nozzle assemblies; and a steam manifold connected to each of the spray nozzle assemblies for providing atomizing steam to each of the spray nozzle assemblies, separately from the cooling water.

8. A spray nozzle assembly for a desuperheater, the spray nozzle assembly comprising:

a housing having a body and a cap flange secured to the body, the body and the cap flange defining a bore within the housing;

a first aperture formed through the body and intersecting the bore;

a second aperture formed through the cap flange and intersecting the bore; and a nozzle sleeve disposed within the bore, the nozzle sleeve comprising:

a solid, unitary sleeve body;

a first fluid passage formed through the sleeve body and in direct fluid communication with the first aperture;

a second fluid passage formed through the sleeve body and in direct fluid communication with the second aperture, a portion of the second fluid passage surrounding the first fluid passage;

a cylindrical inner wall formed between the first fluid passage and the portion of the second fluid passage;

a cylindrical outer wall surrounding the portion of the second fluid passage; and a plurality of support arms extending between the inner wall and the outer wall along a length of the portion of the second fluid passage.

9. The spray nozzle assembly of claim 8, wherein the plurality of support arms extend radially from the inner wall to the outer wall.

10. The spray nozzle assembly of claim 8, wherein the plurality of support arms extend tangentially from the inner wall.

11. The spray nozzle assembly of claim 10, wherein the plurality of walls are arcuate.

12. The spray nozzle assembly of claim 8, wherein the first fluid passage comprises a first section that extends radially across the sleeve body and a second section that intersects the first section and extends longitudinally along the sleeve body.

13. The spray nozzle assembly of claim 8, wherein:

the first fluid passage is in fluid communication with a first exit aperture formed in an end of the sleeve body;

the second fluid passage is in fluid communication with a second exit aperture formed in the end of the sleeve body and with a third exit aperture formed in the end of the sleeve body;

the second and third exit apertures are positioned on opposite sides of the first exit aperture;

the end of the sleeve body comprises a planar first surface that extends perpendicular to a longitudinal axis of the nozzle sleeve and a planar second surface that extends from the first surface and at an acute angle to the longitudinal axis of the nozzle sleeve;

the second exit aperture is formed through the first surface; and the first and third exit apertures are formed through the second surface.

14. The spray nozzle assembly of claim 8, wherein:

the first fluid passage is in fluid communication with a first exit aperture formed in an end of the sleeve body;

the second fluid passage is in fluid communication with a second exit aperture formed in the end of the sleeve body and with a third exit aperture formed in the end of the sleeve body;

the second and third exit apertures are positioned on opposite sides of the first exit aperture;

the end of the sleeve body comprises a planar first surface that extends perpendicular to a longitudinal axis of the nozzle sleeve, a planar second surface that extends from the first surface and at an acute angle to the longitudinal axis of the nozzle sleeve, and a planar third surface that extends from the second surface and parallel to the longitudinal axis of the nozzle sleeve;

the second exit aperture is formed through the first surface;

the first exit aperture is formed through the second surface; and the third exit aperture is formed through the third surface.

15. A desuperheater including the spray nozzle assembly of claim 8, the desuperheater comprising:

a ring body defining an axial flow path;

a plurality of the spray nozzle assemblies disposed around the ring body;

a water manifold connected to each of the spray nozzle assemblies for providing cooling water to each of the spray nozzle assemblies; and a steam manifold connected to each of the spray nozzle assemblies for providing atomizing steam to each of the spray nozzle assemblies, separately from the cooling water.

* * * * *